US007645189B2

(12) United States Patent
Pilger

(10) Patent No.: US 7,645,189 B2
(45) **Date of Patent: *Jan. 12, 2010**

(54) BOOT HANGER MOUNTING BRACKET

(75) Inventor: Allan Pilger, Longview, WA (US)

(73) Assignee: Applied Applications International, Inc., Longview, WA (US)

( * ) Notice: Subject to any disclaimer, the term of this patent is extended or adjusted under 35 U.S.C. 154(b) by 261 days.

This patent is subject to a terminal disclaimer.

(21) Appl. No.: 11/604,946

(22) Filed: Nov. 27, 2006

(65) Prior Publication Data

US 2007/0123161 A1 May 31, 2007

Related U.S. Application Data

(63) Continuation-in-part of application No. 10/828,077, filed on Apr. 19, 2004, now Pat. No. 7,140,960.

(51) Int. Cl.
*F24F 13/02* (2006.01)
*F24F 13/06* (2006.01)
*F16L 5/00* (2006.01)

(52) U.S. Cl. ..... 454/330; 454/292; 454/370; 248/57

(58) Field of Classification Search ..... 454/284, 454/289, 292, 330, 331, 332, 370; 248/57
See application file for complete search history.

(56) References Cited

U.S. PATENT DOCUMENTS

| | | | | | |
|---|---|---|---|---|---|
| 465,561 | A | | 12/1891 | Hood | |
| 943,298 | A | | 12/1909 | Brown | |
| 1,567,089 | A | * | 12/1925 | Symonds | 454/327 |
| 1,690,948 | A | | 11/1928 | Rote | |
| 2,011,797 | A | * | 8/1935 | Covell | 454/331 |
| 2,342,965 | A | * | 2/1944 | Palmer | 454/331 |
| 2,566,558 | A | * | 9/1951 | De Roo | 454/331 |
| 2,661,677 | A | * | 12/1953 | Lingelbach | 454/331 |
| 2,679,796 | A | | 6/1954 | Froelich et al. | |
| 2,965,342 | A | * | 12/1960 | Goldstone | 248/57 |
| 3,236,171 | A | * | 2/1966 | Vladimir et al. | 49/51 |
| 3,238,860 | A | | 3/1966 | O'Day et al. | |
| 3,323,437 | A | | 6/1967 | Knab | |

(Continued)

OTHER PUBLICATIONS

Product description regqrding incandescent lamps [online] [retrieved on Apr. 19, 2004] Retrieved from the Internet: <URL:http://www.junolighting.com.

(Continued)

*Primary Examiner*—Steven B McAllister
*Assistant Examiner*—Patrick F. O'Reilly, III
(74) *Attorney, Agent, or Firm*—Cisto & Thomas, LLP

(57) ABSTRACT

An adjustable boot hanger mounting bracket assembly comprising a boot hanger frame portion and a support member portion; the ductwork components, which may include a prefabricated can-boot/mud ring assembly; a pair of boot hanger arms; and a register grille. The boot hanger mounting bracket assembly is formed of a sturdy yet bendable material so that it can be configured and adjusted on-site. Once configured, the assembly is secured to the building structure by a securing a pair of boot hanger arms to the ceiling joists, wall studs, or other support structure. In this way, the boot hanger mounting bracket, through a direct attachment to the ceiling joist or wall stud, provides a positive inexpensive simple and error free way to mount the duct components.

6 Claims, 26 Drawing Sheets

U.S. PATENT DOCUMENTS

| | | | | | |
|---|---|---|---|---|---|
| 3,522,724 | A | | 8/1970 | Knab | |
| 3,636,340 | A | | 1/1972 | Mulvey | |
| 3,645,044 | A | | 2/1972 | Akre | |
| 3,788,206 | A | | 1/1974 | Mulvey | |
| 3,888,013 | A | | 6/1975 | Benoit | |
| 3,955,483 | A | | 5/1976 | Sunter | |
| 3,985,158 | A | | 10/1976 | Felter | |
| 4,258,784 | A | | 3/1981 | Perry et al. | |
| 4,372,763 | A | | 2/1983 | Champlin et al. | |
| D268,282 | S | | 3/1983 | Wichmann et al. | |
| 4,377,107 | A | | 3/1983 | Izumi | |
| 4,408,262 | A | * | 10/1983 | Kusmer | 362/147 |
| 4,558,582 | A | | 12/1985 | Meinig | |
| 4,760,981 | A | | 8/1988 | Hodges | |
| 4,815,364 | A | | 3/1989 | Wagner et al. | |
| 5,129,690 | A | | 7/1992 | Meinig et al. | |
| 5,338,255 | A | | 8/1994 | Akehurst | |
| 5,338,256 | A | | 8/1994 | Tonna | |
| 5,476,183 | A | | 12/1995 | Harpenau | |
| 5,505,419 | A | | 4/1996 | Gabrius | |
| 5,716,270 | A | | 2/1998 | Chambers | |
| 5,741,030 | A | | 4/1998 | Moore et al. | |
| 5,792,230 | A | | 8/1998 | Moore et al. | |
| 5,928,078 | A | * | 7/1999 | Moore et al. | 454/330 |
| 5,983,496 | A | | 11/1999 | Hermanson | |
| 6,076,788 | A | * | 6/2000 | Akiyama | 248/200.1 |
| 6,192,640 | B1 | | 2/2001 | Snyder | |
| RE37,086 | E | | 3/2001 | Moore et al. | |
| 6,234,894 | B1 | | 5/2001 | Goracke et al. | |
| 6,261,174 | B1 | | 7/2001 | Kuehn | |
| 6,290,597 | B1 | | 9/2001 | Jones et al. | |
| 6,302,784 | B1 | | 10/2001 | Berger | |
| D453,042 | S | | 1/2002 | Mattsson et al. | |
| D454,949 | S | | 3/2002 | Mattsson et al. | |
| D456,071 | S | | 4/2002 | Mattsson et al. | |
| D456,072 | S | | 4/2002 | Mattsson et al. | |
| 6,488,247 | B1 | * | 12/2002 | Gonzalez | 248/201 |
| 6,494,780 | B1 | | 12/2002 | Norbury, Jr. | |
| D475,131 | S | | 5/2003 | Pilger | |
| 7,140,960 | B2 | * | 11/2006 | Pilger | 454/331 |
| 2002/0077059 | A1 | * | 6/2002 | Rutler et al. | 454/289 |

OTHER PUBLICATIONS

Photograph of device from Royal (NMorth Carolina).

* cited by examiner

BOOT HANGER MOUNTING BRACKET

CROSS-REFERENCE TO RELATED APPLICATION(S)

This document is a continuation-in-part application which is co-pending with, and claims priority from, U.S. patent application Ser. No. 10/828,077, also a continuation-in-part application entitled "Boot Hanger Mounting Bracket," filed Apr. 19, 2004, now U.S. Pat. No. 7,140,960 which, in turn, claims priority from U.S. patent application Ser. No. 10/194,570, also entitled "Boot Hanger Mounting Bracket," filed Jul. 11, 2002, both applications of which are incorporated herein by this reference thereto.

TECHNICAL FIELD

This invention technically relates to duct systems, registers and register boots, used as air ducts for warm air heating, ventilating, and/or air conditioning systems. More specifically, the present invention technically relates to improvements for mounting and installing the components of the duct system, including register boots, mud rings and air registers, in the walls, floors, or ceilings of buildings.

BACKGROUND ART

Forced air heating, ventilation, and cooling (HVAC) systems are designed to provide control of space temperature, humidity, air contamination, differential pressurization, and air motion. These distribution systems use a network of ducts to deliver the heated and/or cooled air to the various rooms and spaces within a building structure. Of the many HVAC systems currently available, galvanized sheet steel duct systems are among the most widely used. These systems generally consist of an air heating and/or refrigeration unit, straight sections of duct, and multiple types of fabricated fittings and connections. From these fittings and connections, the straight sections of duct are connected to each other and to openings or vents in the rooms and spaces of the building structure. Currently, the ductwork connections and fittings are fabricated primarily by experienced sheet metal workers.

Where the ducts are accurately sized and the duct system is correctly designed, the air will be delivered to the rooms and spaces with a minimum of resistance. In HVAC systems, the ductwork interfaces with the room through one or more open-end duct portions. Generally, a grille or louver is mounted on the interfacing end of the duct to face into the room. Because the grilles generally must be mounted to the wall studs or ceiling joists, or to the ducts themselves, a risk exists that the grilles may be insecurely mounted or mounted at odd angles, particularly where the grilles are first attached and subsequently temporarily removed for wall painting or cleaning or other purposes.

Several considerations regarding the design of the connections and fittings used in HVAC systems are important. First, the connections and fittings are difficult to store, handle, and transport without incurring damage. In addition, due to their shape and design, they require a large quantity of space per unit to store and transport. These problems cause the production of excessive scrap and increased inventory holding and transportation costs for the distributor and customers.

Additionally, the configuration of the ductwork and grilles poses a problem for unskilled construction workers and is extremely time consuming. Generally, this work involves fitting together preformed components that frequently differ in dimensions and require careful measuring and positioning during the installation process so that the components fit together and so that no gaps are created. For example, a worker will commonly transpose the dimensions of the grille register onto the area of the wall or ceiling opening to ascertain the dimensions of the opening to be cut; or alternately he will select a standard size commercially available register grille to fit into a pre-existing opening. Because any measurements can introduce inaccuracies, the possibility that the components will not fit together or provide support for the grille register and boot in the wall or ceiling opening or create gaps between the edges of the opening and the grille register is a real concern. In these cases, another bracket must be brought to the site and used, or the grille opening must be modified or the grille register replaced with a different size so that the components fit together and so that the register and boot are securely supported in the opening in the wall or ceiling. In light of the above-noted problems in the related art and in an attempt to hasten the installation process as well as to avoid waste of materials, a long-felt need for new installation methods and devices exists.

DISCLOSURE OF THE INVENTION

An object of the present invention is to overcome the above-noted problems in the related art and other drawbacks by providing an assembly to support and mount ductwork components of HVAC systems. The assembly has a simple versatile construction and can be quickly and easily assembled. Further, the assembly may be stored and transported in a flattened state and can be adjusted on-site to provide an accurate fit between the boot register, grille and wall, floor, or ceiling opening, which reduces costs.

The present invention allows for easy transportation, storage, and on-site installation while providing an adjustable assembly that provides solid backing for mounting the ductwork components. Generally, the invention includes a boot hanger mounting bracket assembly comprising a boot hanger frame portion and at least one support member; ductwork components, such as a can-boot and mud ring, that may be prefabricated; a pair of boot hanger arms; and an airflow control structure, such as a register grille. The boot hanger mounting bracket assembly is preferably configured so that the boot hanger frame portion interfaces with the support member(s) and comprises two pairs of parallel rearward projecting flanges along its sides.

The support member preferably comprises a tabbed portion or "lip" and a pair of parallel sidewalls. The lip of the support member is preferably configured at an approximate right angle to the sidewalls of the support member so that the lip may lie flush against the surface of the boot hanger frame portion. The lip may be secured to the boot hanger frame portion by a securing material such as, for example, spot welds, button punches, epoxy or riveting, or other suitable structure.

The boot hanger frame portion and support member(s) are preferably configured so that a portion of the support member (s) projects beyond the front face of the boot hanger frame portion to receive the airflow control structure. The support member, and the boot hanger frame portion, may be preformed or may be transported in a low profile state to the work site so that the boot hanger mounting bracket assembly can be configured on-site to interface with the particular ductwork components, such as can-boot, and register grilles.

The support member may be formed of a sturdy yet bendable material so that it can configured, on-site if desired, to form a pocket, into which a portion of, or an edge of, the boot or other duct work component sits and to form the lip, which interfaces with and is preferably secured to the boot hanger frame portion. The finished boot hanger mounting bracket assembly may then be secured to the building structure by securing the boot hanger arms to the boot hanger frame portion and to the ceiling joists, wall studs or other structure. In this way, the boot hanger mounting bracket assembly, through a direct attachment to the ceiling joist or wall stud, provides a positive inexpensive simple and error free way to mount the duct components.

Advantages of the present invention include a simple versatile construction as well as facile rapid assembly. Another advantage of the present invention is that it may be stored and transported in a flattened state and can be adjusted on-site to provide an accurate fit between the boot register, grille and wall, floor, or ceiling opening, which reduces costs. Other features of the present invention are disclosed, or are apparent, in the section entitled "Mode(s) for Carrying-Out the Invention," disclosed, infra.

BRIEF DESCRIPTION OF THE DRAWING

For better understanding of the present invention, reference is made to the below-referenced accompanying Drawing. Reference numbers refer to the same or equivalent parts of the present invention throughout the several figures of the Drawing.

MODE(S) FOR CARRYING-OUT THE INVENTION

Figure 1:
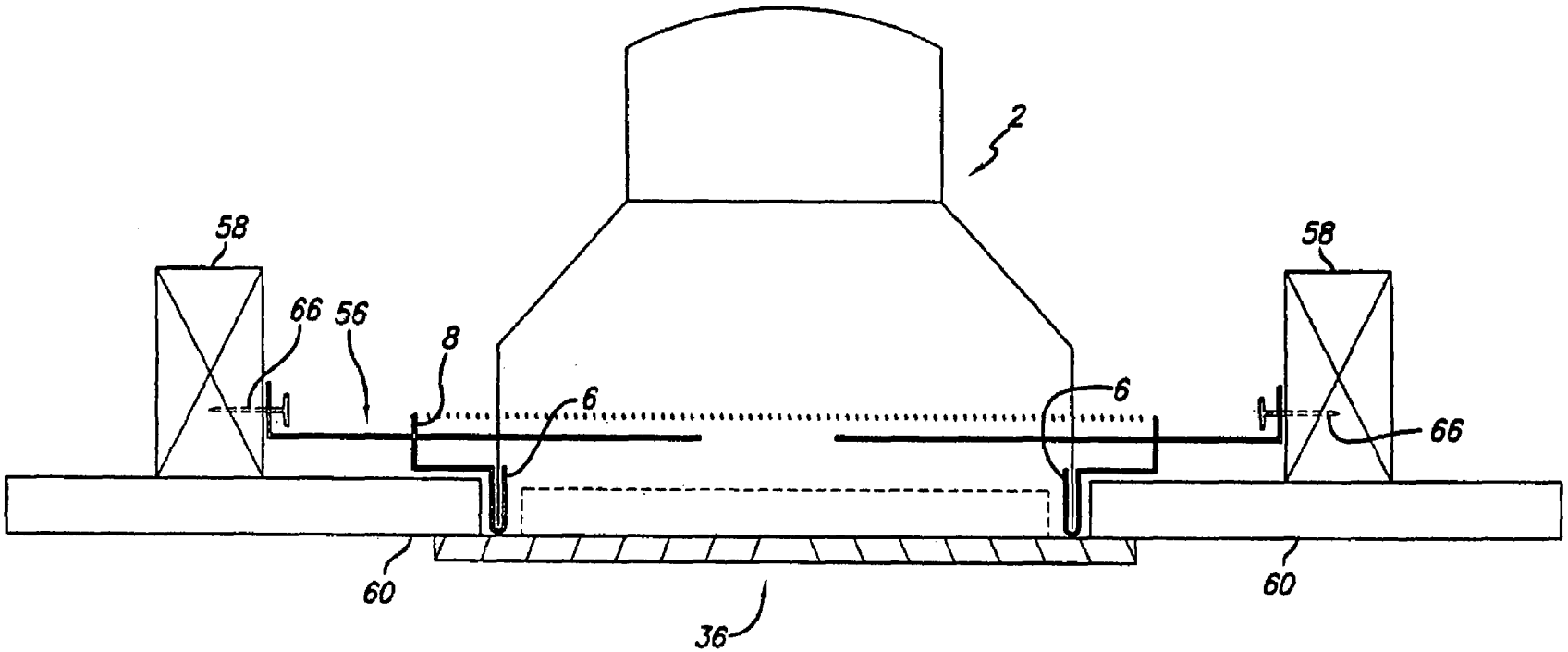
FIG. 1 is a cutaway side view of the present invention mounted in a structure between two ceiling joists.

Turning to the drawings, and more particularly to FIG. 1, the typical environment lo which the present invention is operated is illustrated. As shown in FIG. 1, a typical vertical ceiling joist 58 is shown. Although FIG. 1 illustrates the present invention mounted in a ceiling, it is contemplated that the present invention may be mounted within the floor, wall, ceiling, or other portion of a building structure. Attached to the ceiling joist 58 is a ceiling lid 60 formed from materials such as dry wall or sheet rock. FIG. 1 also shows an airflow control structure 36, such as an air register grill or louver, mounted within the ceiling of a room.

The present invention generally may comprise pre-fabricated ductwork components such as a can-boot 2; a boot hanger mounting bracket assembly 4 comprising at least one support member 6 and a boot hanger frame portion 8; and a pair of boot hanger arms 56. The present invention contemplates that the can-boot or other ductwork component 2 may be pre-fabricated and fit together prior to arriving at the work site, or alternately, semi-fabricated and configured at the site. The invention may be used with an airflow control structure 36 and may include a commercially available standard register grille or grilles. The boot hanger arms 56, each arm 56 having two ends or two feet, may be mounted to the ceiling joists 58 by fastening members such as, for example, nails or screws, wherein the nail comprises a bell-headed nail for facilitating relocation of the hanger frame portion 8. The feet of each arm 56 may comprises a height of approximately 0.5 inch for allowing the assembly 4 to be applied to multifamily projects that use a rated channel (RC) or a hot channel furring strip which would lower the hanger body by approximately 0.5 inch in order to interface with an unfinished side of a building envelope which may be furred-down by approximately 0.5 inch. It is contemplated that the invention may be disposed within an opening that is in communication with the ductwork of a central heating or cooling system or a ventilation system (not shown) of a structure.

Figure 2:
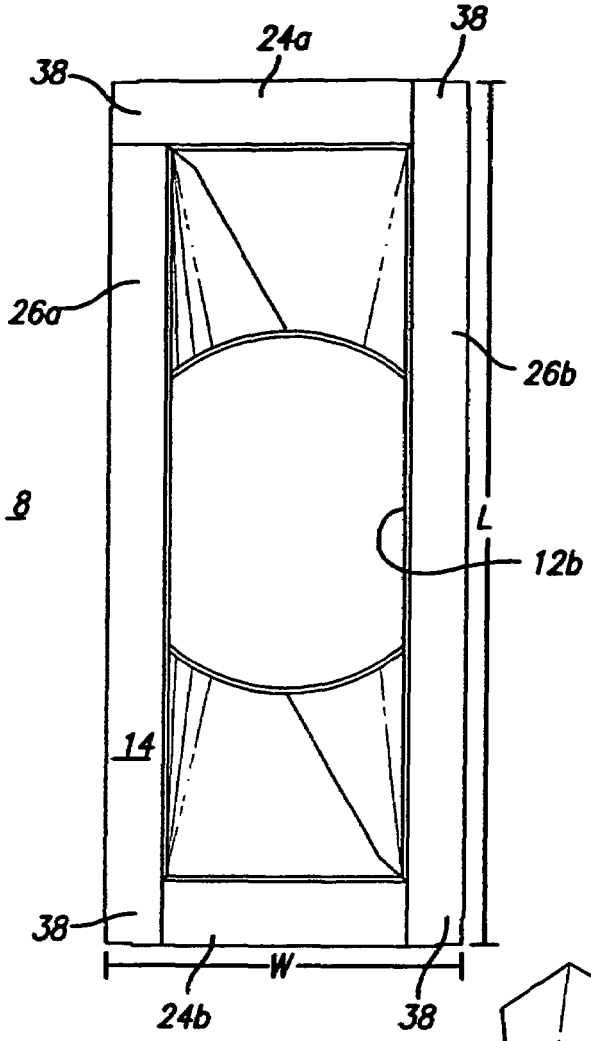
FIG. 2 is a front plan view of the boot hanger frame portion and interior of the can-boot and mud ring components of the ductwork.
Figure 3:
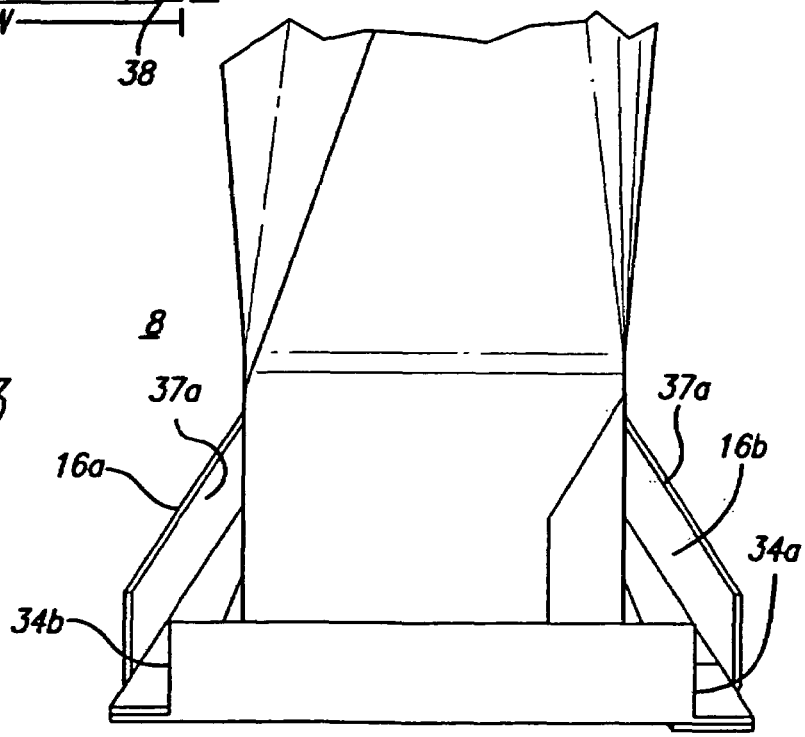
FIG. 3 is a close-up side view of the boot hanger frame flanges and can-boot component of the ductwork in a third version of the present invention.
Figure 4:
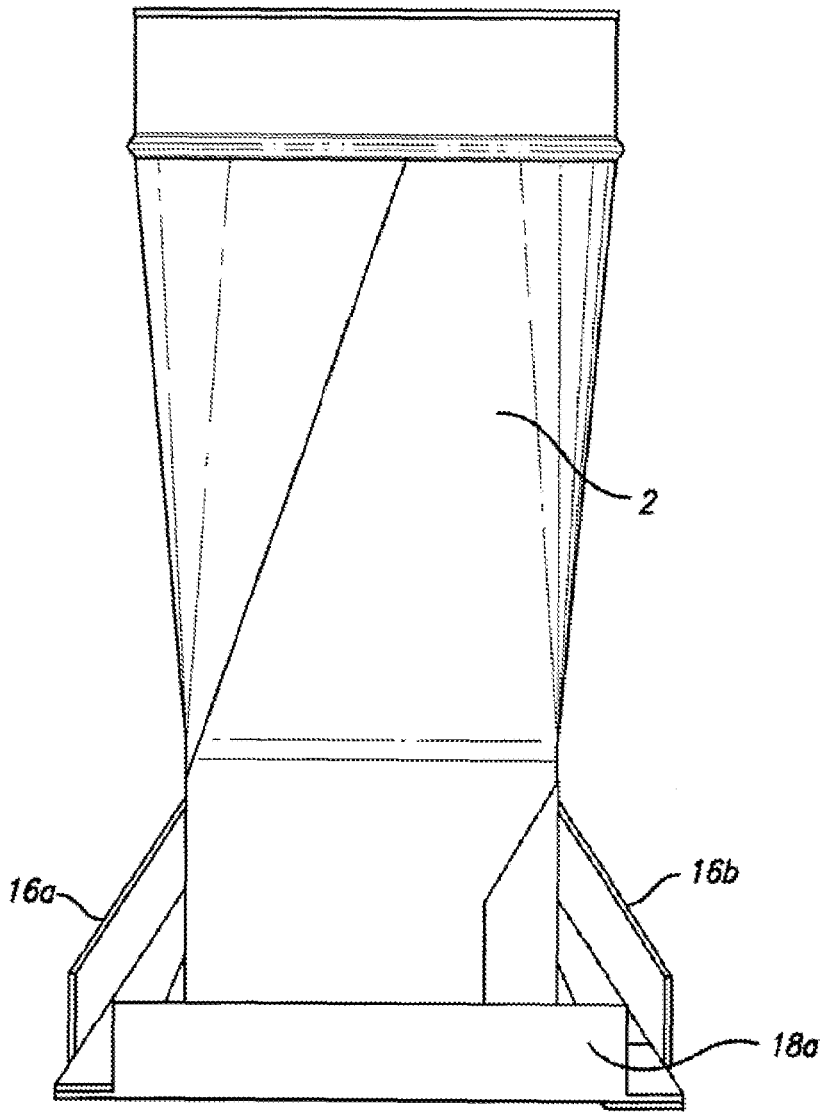
FIG. 4 is a side view of the boot hanger frame flanges and can-boot component of the ductwork in a third version of the present invention.
Figure 5:
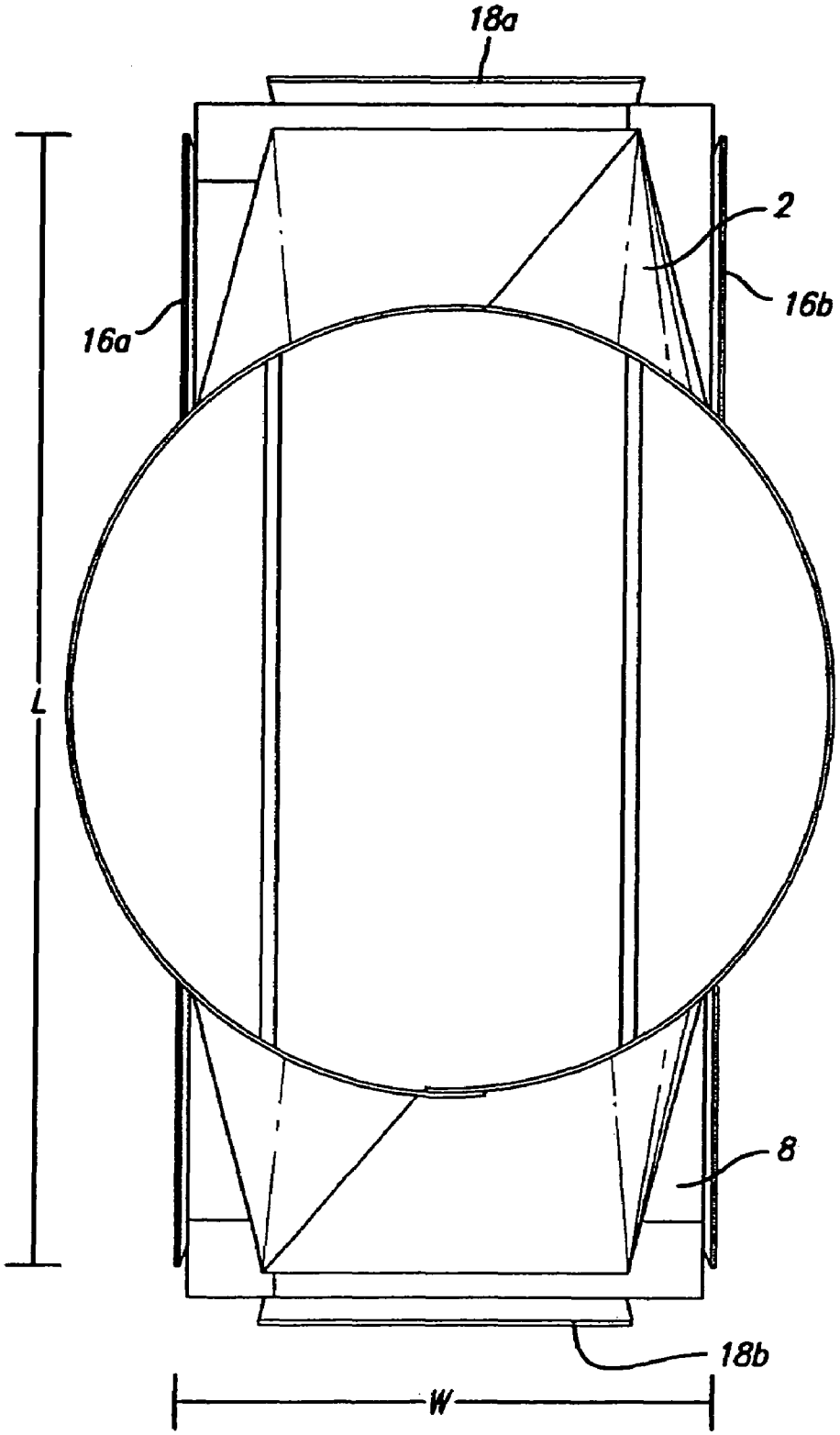
FIG. 5 is a top plan view of a mud ring, can-boot and boot hanger frame portion in a third version of the present invention.
Figure 6:
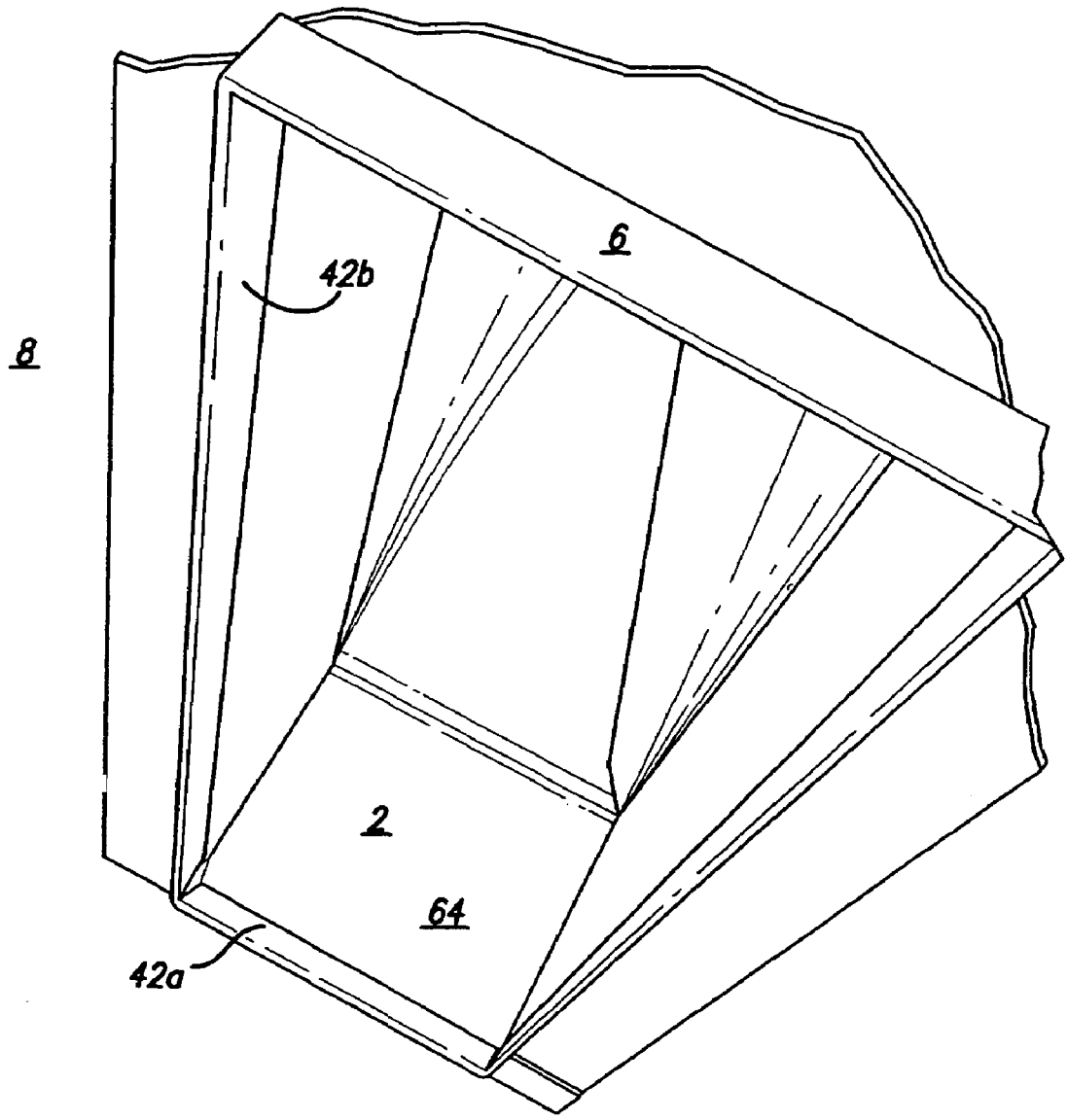
FIG. 6 is a perspective bottom view of the present invention showing the interior of the can-boot, the interface of the can-boot edges and the support member and the boot hanger frame.

The support member 6 and boot hanger frame portion 8 has a length, l dimension and width dimension, w, and when fitted together to form the boot hanger mounting bracket 4, defines an opening 12*b* (FIG. 2). The size of the opening 12*b* may vary to fit most residential and commercial HVAC needs and grille or register sizes. By way of example only, in a first version of the preferred embodiment, the boot hanger frame portion 8 and support member 6 may be configured to form a boot hanger mounting bracket assembly 4 having an opening 12*b* of approximately thirty (30) cm in length by approximately ten (10) cm in width. Examples I and II herein illustrate without limitation other suitable dimensions of the components of the boot hanger mounting bracket assembly 4. The dimensions of the boot hanger mounting bracket assembly 4, and its components, may vary according to the dimensions of the can-boot or other ductwork components 2, and airflow control structure 36 required for the particular application.

Referring to FIGS. 2-5, the boot hanger frame portion 8 preferably comprises a planar surface 14 defining an opening 12*b* and two pairs of parallel rearward projecting flanges 16*a*, 16*b*, 18*a*, 18*b* along, respectively its length, l, and width, w. Each flange comprises a pair of parallel edges 34*a*, 34*b* and a rear edge 37*a*. In the preferred embodiment, the boot hanger frame portion 8 may be formed from a sheet of material by, for example, using stamping and cutting.

Alternately, the boot hanger frame portion 8 may be formed by separate components, such as, for example, two sets of parallel, galvanized metal strips 26*a*, 26*b* and 24*a*, 24*b* forming respectively, the length, l, and width, w, of the boot hanger frame portion 8 (e.g., FIG. 2). The strips or flat sheet may be formed from materials comprising, for example, galvanized metals, aluminum, steel, high impact polystyrene or of resin formulations such as ABS resin, or other suitable materials.

Figure 14:
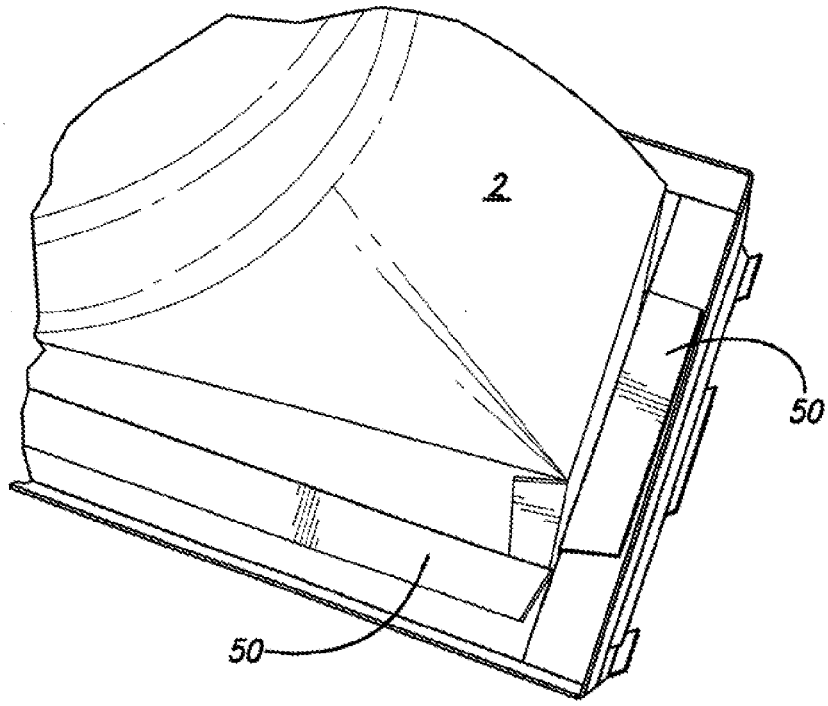
FIG. 14 is a top perspective view of the ductwork component and lip of the support member and the boot hanger frame portion in a first version of the preferred embodiment.

The boot hanger frame portion may be brought to the work site with the flanges 16*a*, 16*b*, 18*a*, 18*b* pre-formed, or the flanges may be formed on-site by, for example, manual bending of pre-etched lines or by use of suitable metal working devices. In a first version of the preferred embodiment, two parallel flanges (e.g., 16*a*, 16*b* or 18*a*, 18*b*) are approximately the same length as the respective side of the boot hanger frame portion 8 from which they project. The remaining two parallel flanges are preferably slightly longer in length than the side of the boot hanger frame portion 8 from which they project to create an overlapping portion 102, which interfaces with, and may be secured to, the adjacent flange (e.g., FIG. 14, FIG. 21).

Figure 26A:
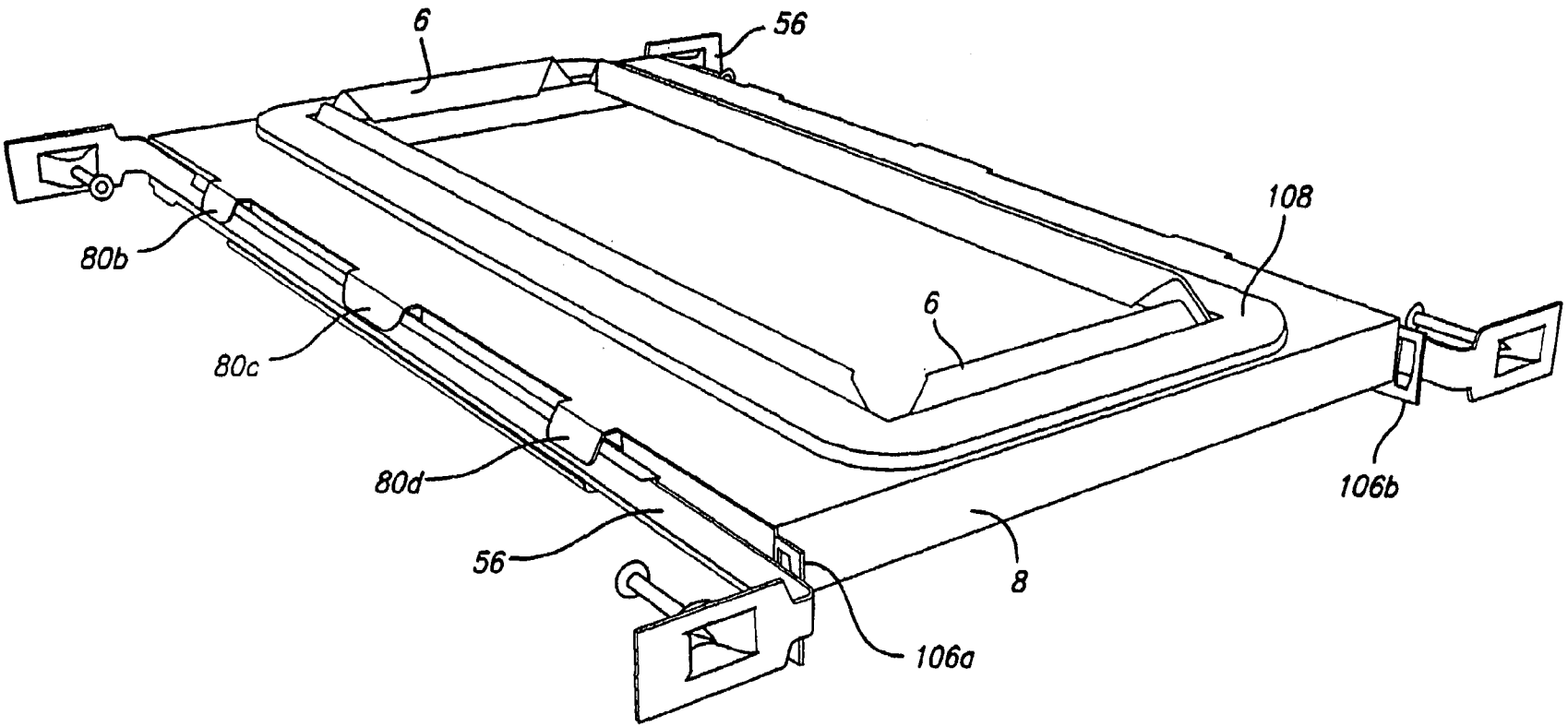
FIG. 26*a* is a side perspective view of the boot hanger mounting bracket and gasket.
Figure 26B:
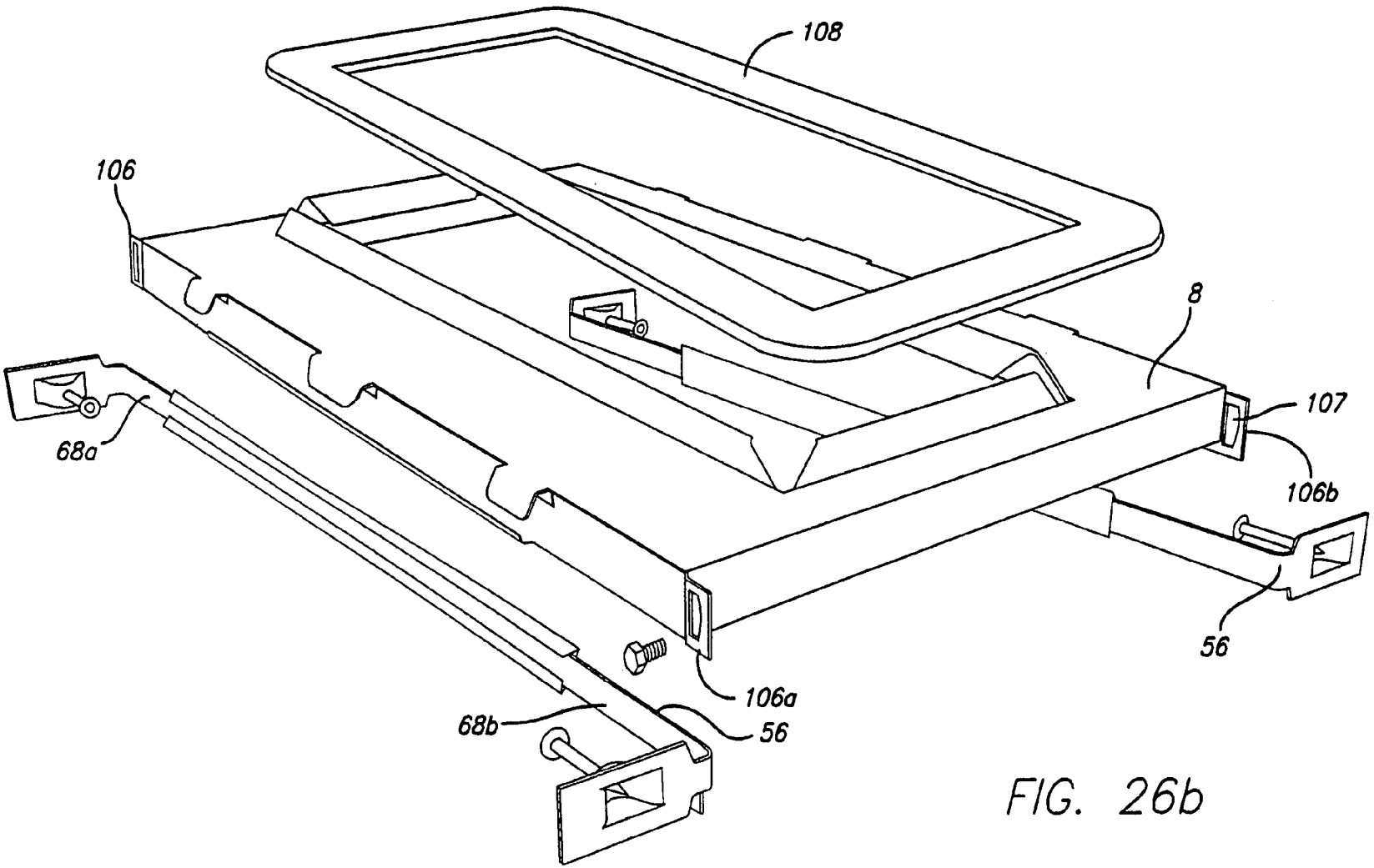
FIG. 26*b* is an exploded view of the boot hanger mounting bracket and gasket.
Figure 28:
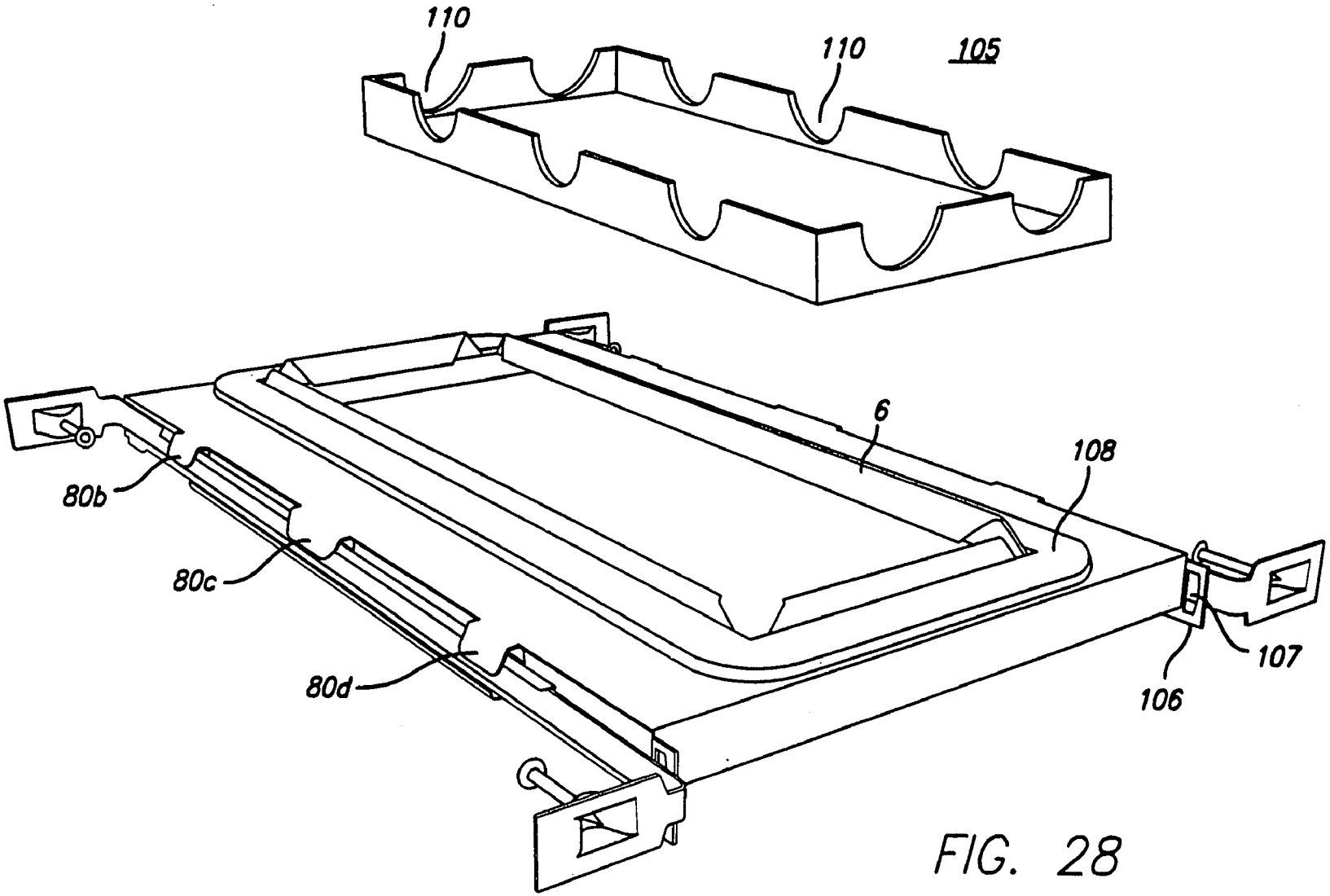
FIG. 28 is a semi-exploded side view of the boot hanger mounting bracket and insert.

In a second version of the preferred embodiment, at least two flanges are longer than the side of the boot hanger frame portion 8 from which they project. In this version, the longer flanges are preferably parallel to one another and extend beyond the end of the boot hanger frame portion 8 from which they project to form two extended portions 106*a*, 106*b*, as shown in FIGS. 26*a*, 26*b* and 28. Extended portion 106 preferably comprises a cut-out 107 that is configured to receive the boot hanger arms 56. In an alternate version of the invention, flanges 16*a*, 16*b*, 18*a*, 18*b* may be shorter in length than the respective sides of the boot hanger frame portion from which they project rearward, as shown in, for example, FIGS. 3-5.

The support member(s) 6 are configured to receive a portion of the can-boot, or other ductwork component, 2 and to interface with the boot hanger frame portion 8. The support members 6 may be pre-formed or taken to the site in a flattened or low profile state for easy transport. If formed on-site, the sides and dimensions of the support members 6 may be formed by manually bending the sheet material from which the support member portion 6 is formed, or by using suitable metal working devices known in the art. The material may comprise etched or marked lines 90 to facilitate the bending and formation process.

Figure 15:
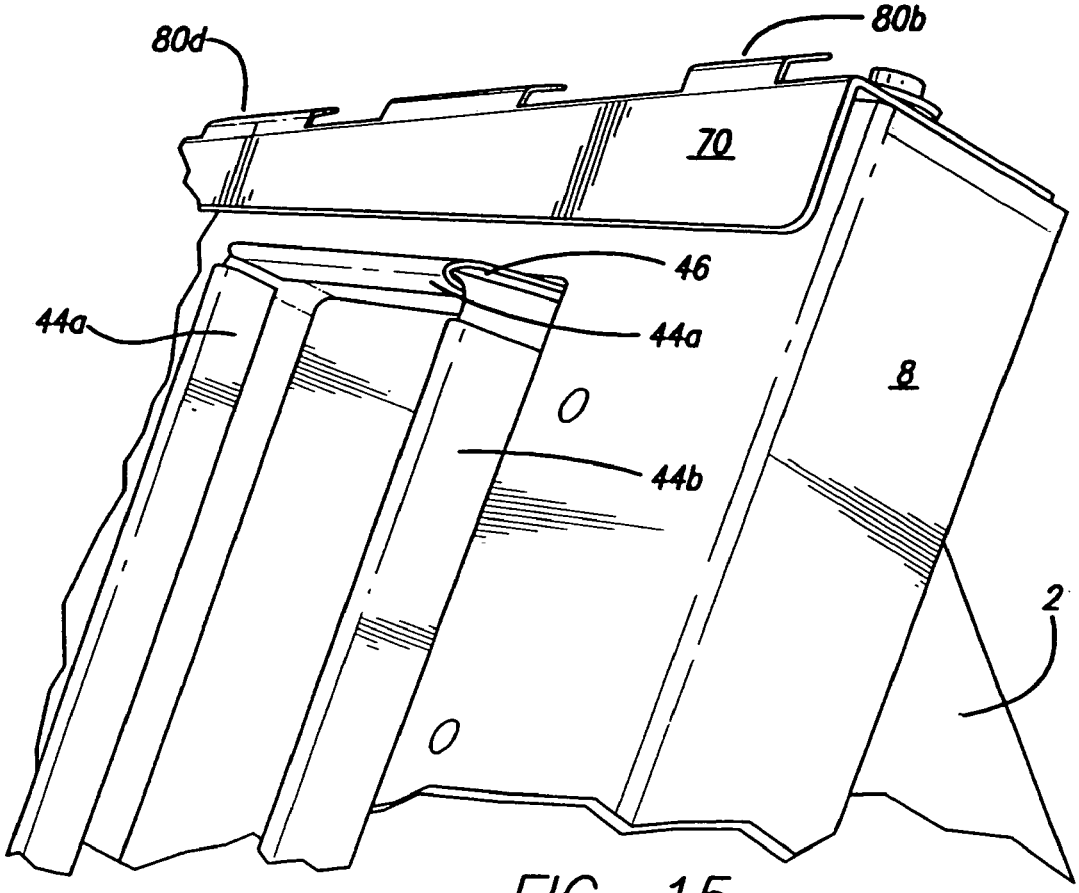
FIG. 15 is a side perspective view of the support member sidewalls, bracket, and the boot hanger frame portion in a first version of the preferred embodiment.
Figure 16:
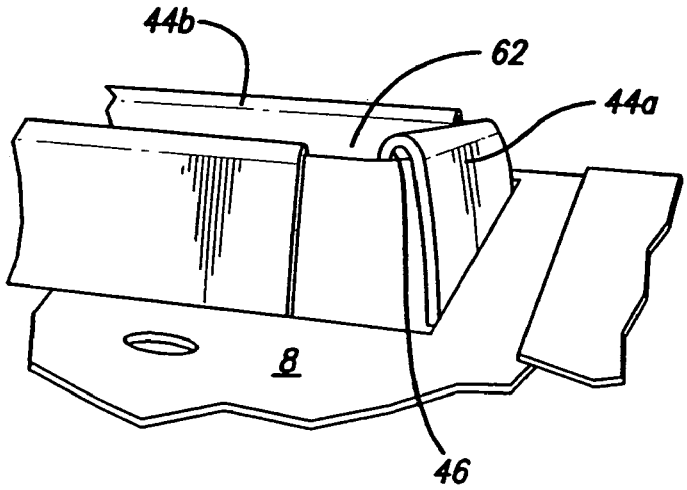
FIG. 16 is a close-up side perspective view of the support member sidewalls, pocket and the boot hanger frame portion in a first version of the preferred embodiment.
Figure 17:
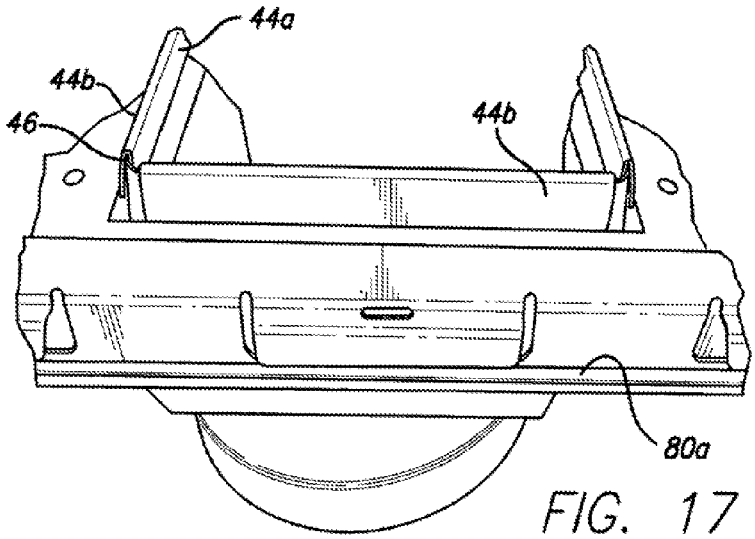
FIG. 17 is a front perspective view of the ductwork component and sidewalls of the support member and the bracket in a first version of the preferred embodiment.
Figure 27:
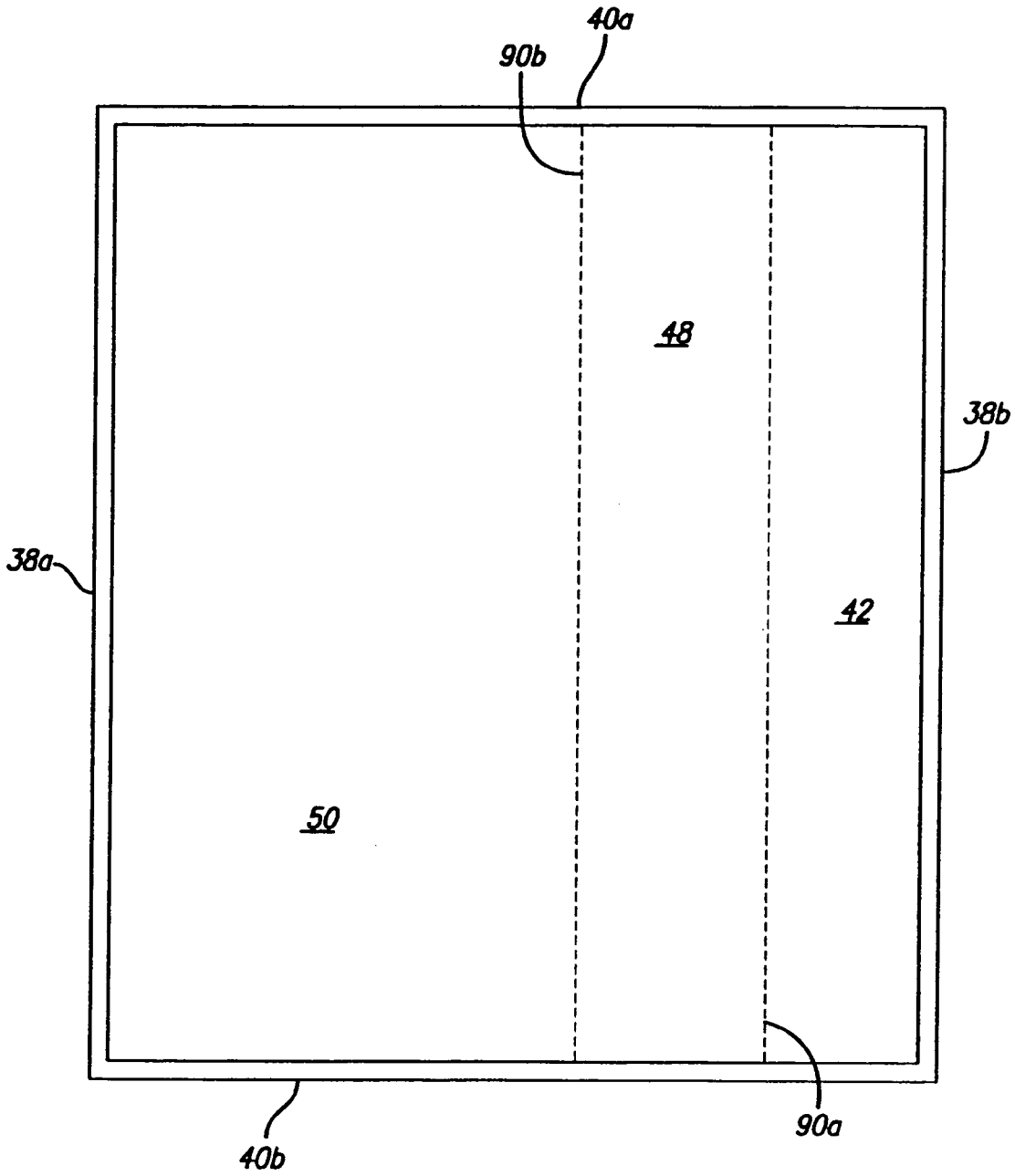
FIG. 27 is a diagram of the support member comprising pre-etched lines and the inner tab, outer tab and lip.

In the preferred embodiment, the support member 6 comprises a strip, piece or sheet of material having two sets of parallel sides 38*a*, 38*b* and 40*a*, 40*b* (FIG. 27). The support member 6 may be formed of galvanized metal, ABS plastic resin, aluminum, steel, or other suitable materials known in the art. In finished form, the support member 6 comprises a pair of parallel sides defining a slot or "pocket", and a lip (see e.g. FIGS. 15-16). The finished support member 6 may be formed from a flat sheet of material by folding or bending a portion of one side to form a first sidewall 44*a*, and by folding the opposite parallel side, preferably in an opposite direction, to form lip 50 and a second sidewall 44*b*. In the preferred embodiment, sidewalls 44*a*, 44*b* define a pocket 46 (see e.g., FIGS. 15-16).

Once the support member 6 is formed or semi-formed, it may be fit together with the boot hanger frame portion 8. The lip 50 may be formed at this time, or alternately may be formed before fitting the boot hanger frame portion 8 with the support member 6 and further adjusted in relation to the boot hanger frame portion 8. The lip 50 is preferably configured so that it lies flush against the surface 14 of the boot hanger frame portion 8.

In one version of the preferred embodiment, the sheet of material forming the support member 6 comprises an inner tab 42 and an outer tab 48. The inner tab 42 may be bent or folded in one direction; for example at pre-etched line 90*a;* and the outer tab 48 folded or bent in an opposite direction; for example at pre-etched line 90*b;* to configure a support member 6 comprising two sidewalls 44*a*, 44*b* defining a pocket 46, and lip 50. By way of example only, a support member 6 of approximately 4.5 cm wide to about 13.5 cm wide may comprise an inner tab 42 of approximately 1.0 cm to 3.0 cm in width and outer tab 48 of approximately 1.0 to 3.0 cm wide. In this example, inner tab 42 may be folded at line 90*a* in one direction and outer tab 48 may be folded at line 90*b* in an opposite direction to create approximately 1.0 to 3.0 cm sidewalls and a lip 50 of approximately 2.5 cm to about 7.5 cm.

The support member 6 may then be securely fastened to the boot hanger frame portion 8 by fastening lip portion 50 to its surface 14. The front edges 62 of the can-boot or other ductwork component 2 may then be fit into the pocket 46 created by the folded inner 42 tab.

Figure 29:
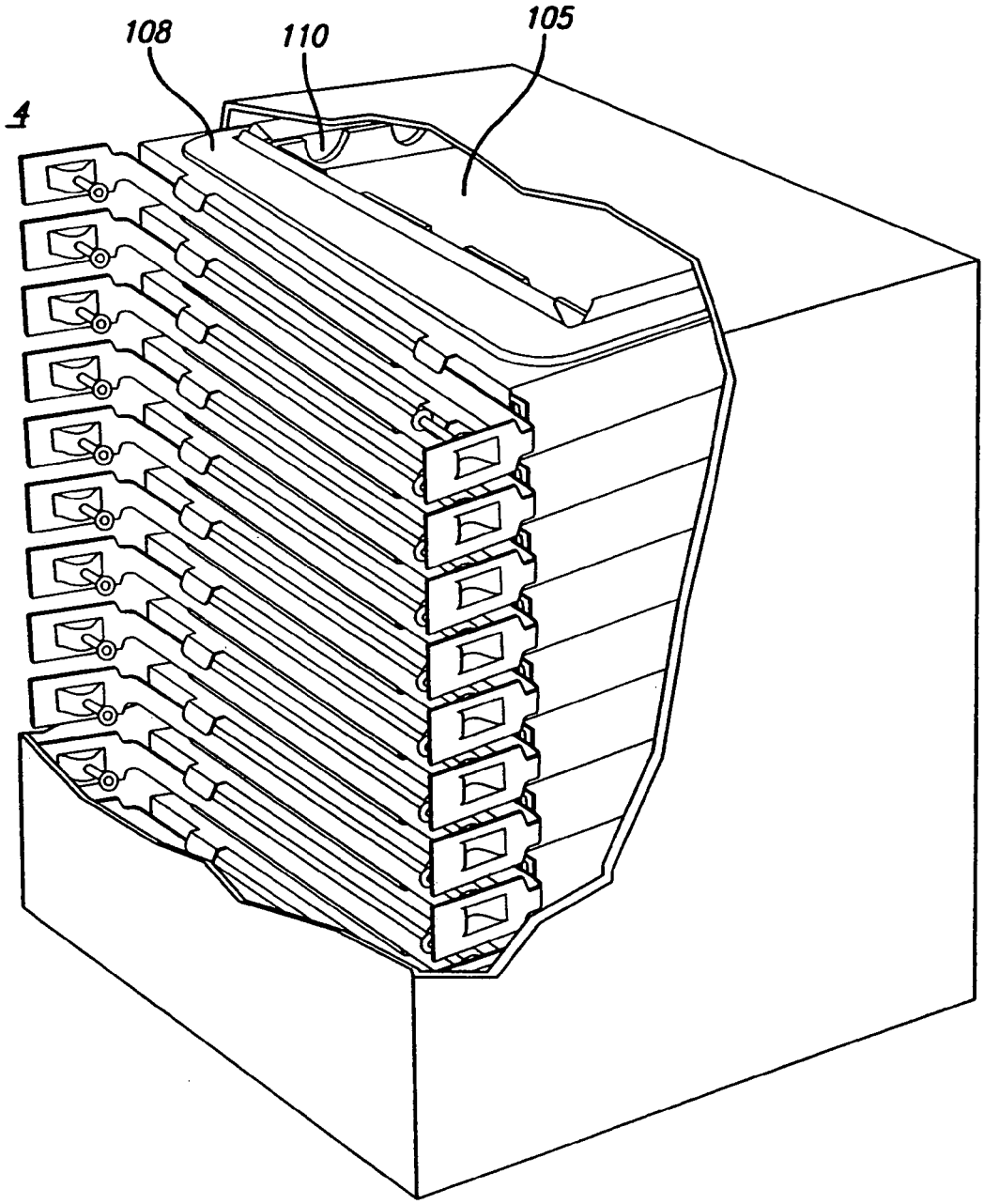
FIG. 29 is a side cut-away perspective view of multiple boot hanger mounting bracket assemblies stacked in a shipping carton and including the insert.

The invention disclosed herein permits flexibility in assembly in that the components may be brought in a compact form to the work site and assembled on site or may be brought to the work site pre-formed. In addition, the assembled boot hanger mounting bracket assemblies may be configured so that they stack together in a compact configuration for shipping (see e.g., FIG. 29) and are easily removable from the shipping carton.

Once the support member(s) 6 are fit together with the ductwork components 2, the material forming the sidewalls 44*a*, 44*b* of the support member 6 may then be pressed, stapled or otherwise adjusted by suitable structure to provide a snug fit between the support member 6 and can-boot or other ductwork component 2. Alternately, the support member(s) may be configured so that it will expand, for example upon applying pressure, to receive a portion of the ductwork 2 component. In this version, the ductwork component may be removed and re-inserted into engagement with the support member 6. The adjustment step may be performed before or after securing the lip 50 to the boot hanger frame portion 8. Once adjusted, a portion of the folded inner tab 42 may be secured to the interior surface 64 of the can-boot or other ductwork component 2.

In the preferred and alternate embodiments, a gasket 108 may be used, for example, to prevent air from flowing past certain portions of the ductwork and/or to aid in sealing certain interfaces, including, for example, the interface between the assembled boot hanger mounting bracket 4 and the building structure (e.g., wall, ceiling, or floor) and/or the interface between the support member(s) 6 and the boot hanger frame portion 8. By way of example, the gasket 108 may be disposed between the boot hanger mounting bracket 4 and the building structure (e.g. wall, floor or ceiling), or between the ductwork component 2 and the boot hanger mounting bracket 4. The gasket 108 is preferably comprised of a foam material but may comprise other suitable materials known in the art. The gasket may be secured by gluing or other suitable structure.

Figure 30:
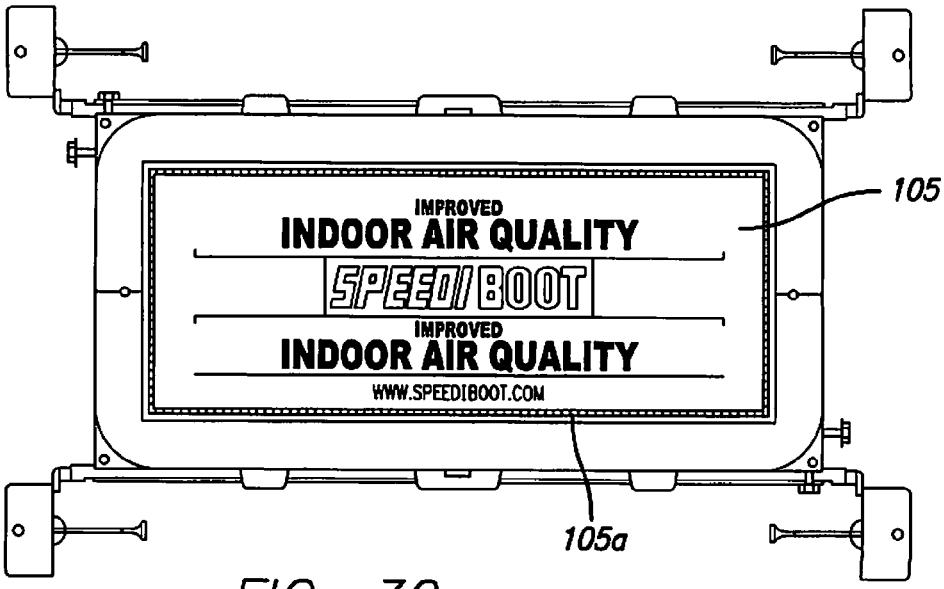
FIG. 30 is a front view of a dust and debris cover, comprising a portion for accommodating text, a logo, or a trademark, in accordance with the present invention.
Figure 31:
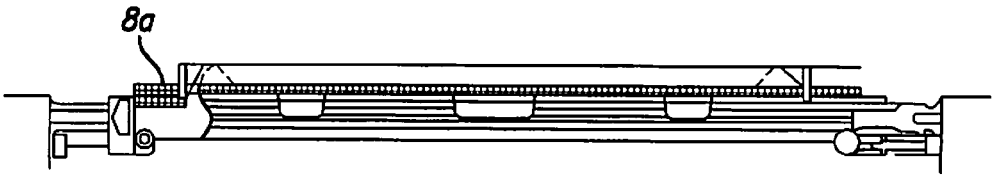
FIG. 31 is a bottom view of a dust and debris cover, comprising a portion for accommodating text, a logo, or a trademark, in accordance with the present invention.
Figure 32:
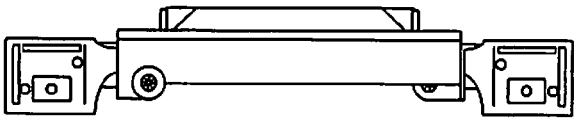
FIG. 32 is a side view of a dust and debris cover, comprising a portion for accommodating text, a logo, or a trademark, in accordance with the present invention.
Figure 33:
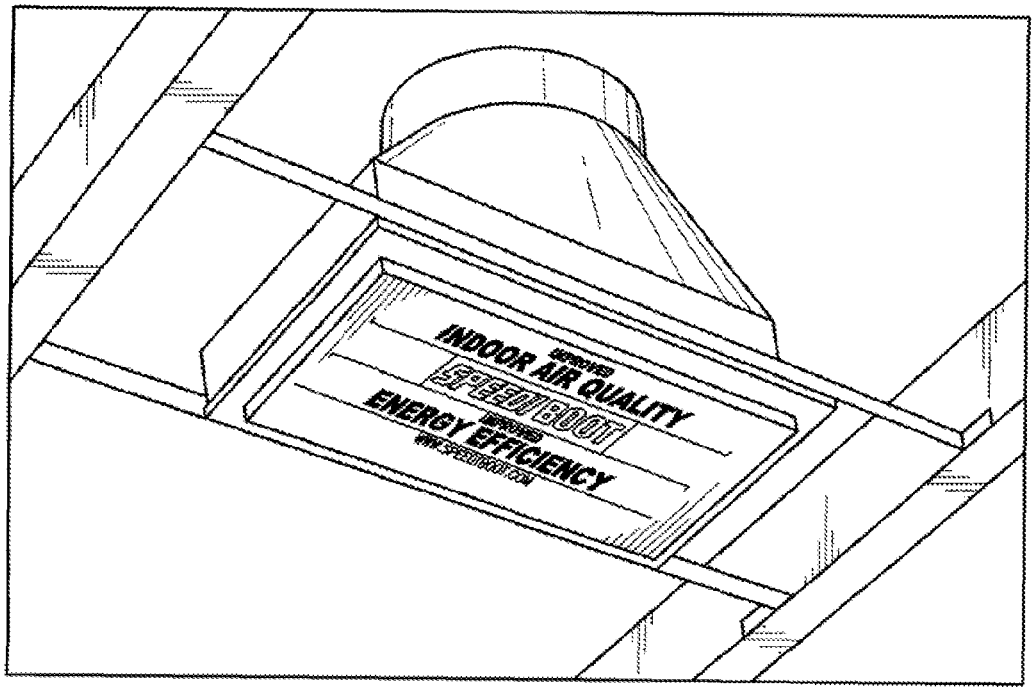
FIG. 33 is a perspective view of a dust and debris cover, comprising a portion for accommodating text, a logo, or a trademark, in accordance with the present invention.

Also, in the preferred and alternate embodiments, an insert 105 may be used in the opening 12*b* while assembling and installing the boot hanger mounting bracket 4 and ductwork components to prevent debris and materials outside the building structure from entering the interior of the building space and/or vice-versa. The insert 105 is preferably configured so that it can be easily removed at any time during or after completing installation of the ductwork or other components, or before operation of the heating, air conditioning or ventilation system. The insert 105 may comprise cardboard, corrugated cardboard, foam, plastic, sheet metal or other suitable materials known in the art. The insert 105 preferably comprises "half-moon" shaped indentations, holes 110 or other suitably-shaped indentations so that the insert 105 does not interfere with placement and configuration of the ductwork components 2 and so that it can be easily removed. The insert 105 may comprise a cover having a portion for accommodating at least one element selected from a group consisting essentially of text, a logo, and a trademark (FIG. 30). The present invention may further comprise at least one element such as a tape 105*a* disposed around the insert 105, for providing a better seal between the insert 105 and the frame portion 8 (FIG. 30), and a gasket 8*a* disposed around the frame portion 8 (FIG. 31). The gasket 8*a* may comprise a sealing material such as foam and may be glued onto the frame portion 8 (FIG. 31).

Figure 7:
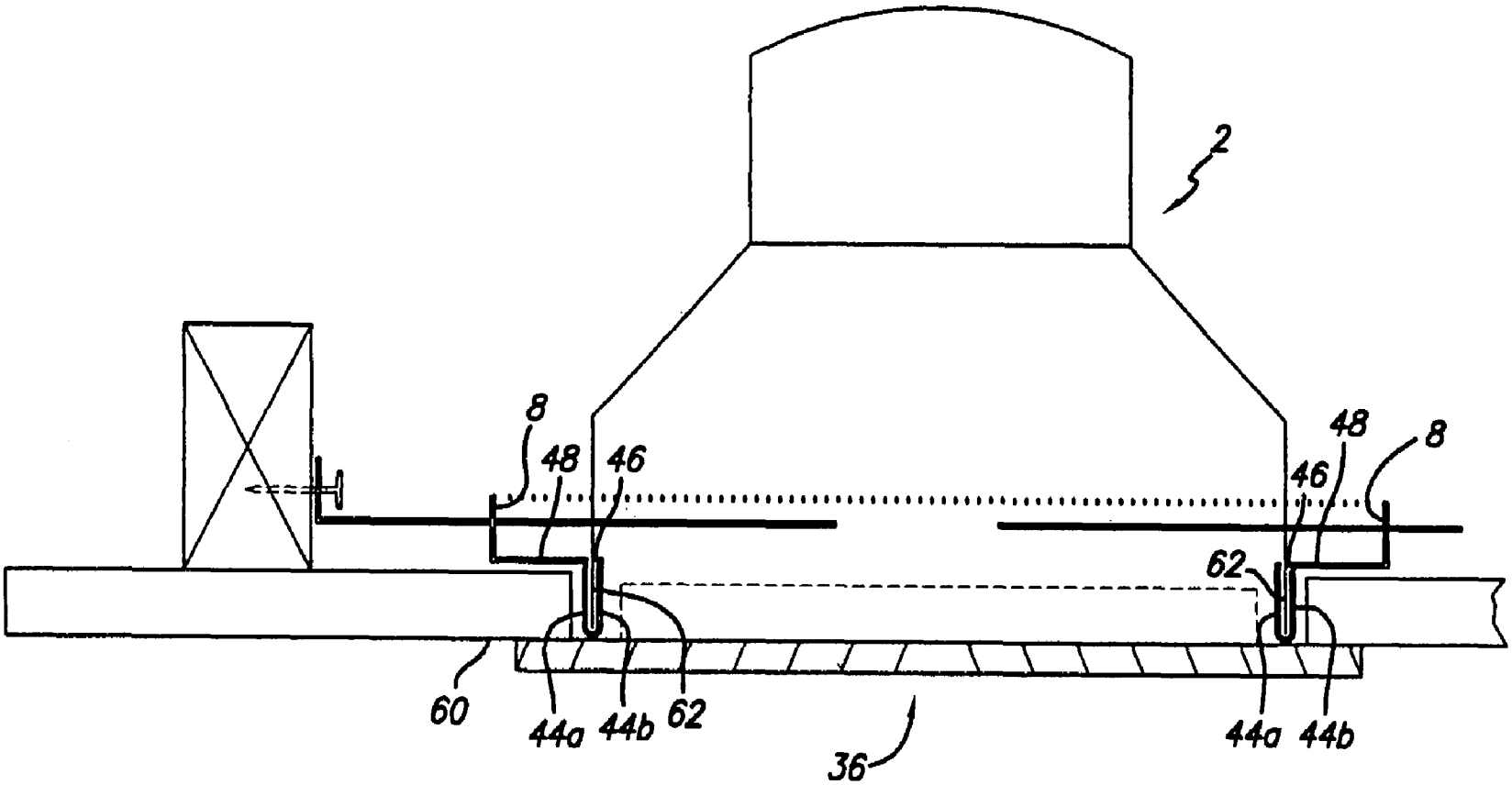
FIG. 7 is an enlarged cutaway side view of the present invention, as mounted between the ceiling joists of a structure, showing the pockets defined by the sidewalls of the support member.
Figure 8:
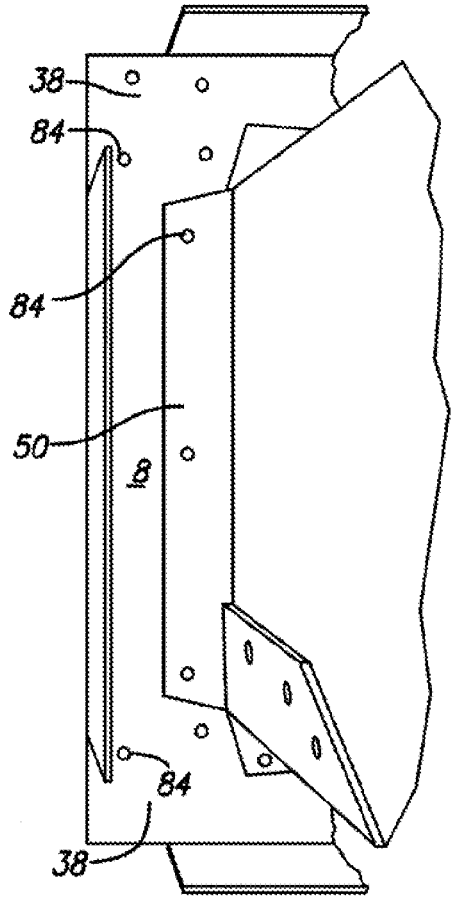
FIG. 8 is an enlarged top plan view of the boot hanger frame portion and can-boot, showing attachment of the lip of the support member to the front surface of the boot hanger frame in a third version of the present invention.
Figure 11:
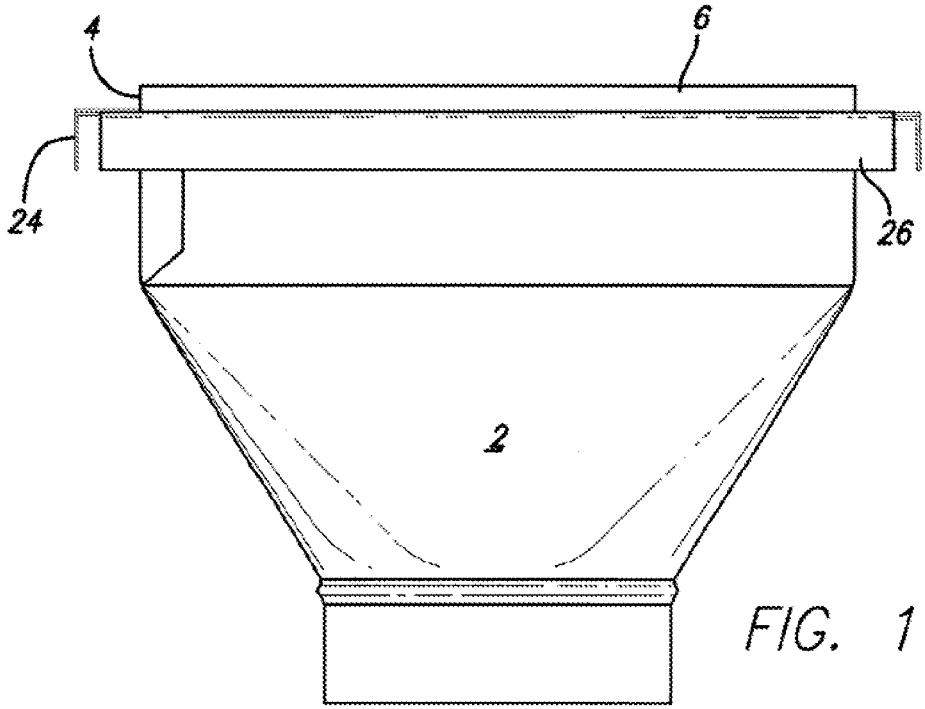
FIG. 11 is a side view of the mud ring, can-boot, boot hanger frame portion and support member in an alternate version of the present invention.
Figure 18:
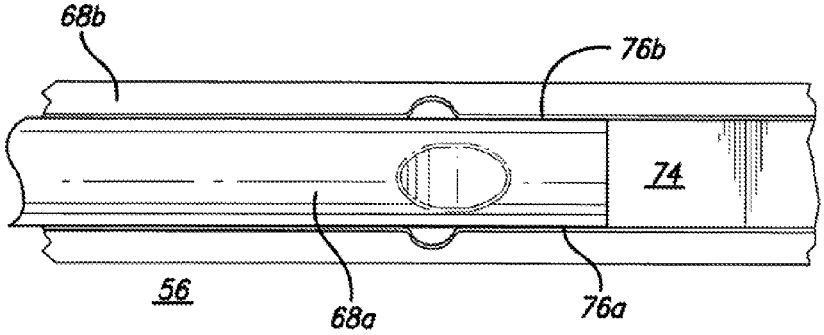
FIG. 18 is a rear perspective view of the elongated elements of the boot hanger arms in a first version of the preferred embodiment.
Figure 22:
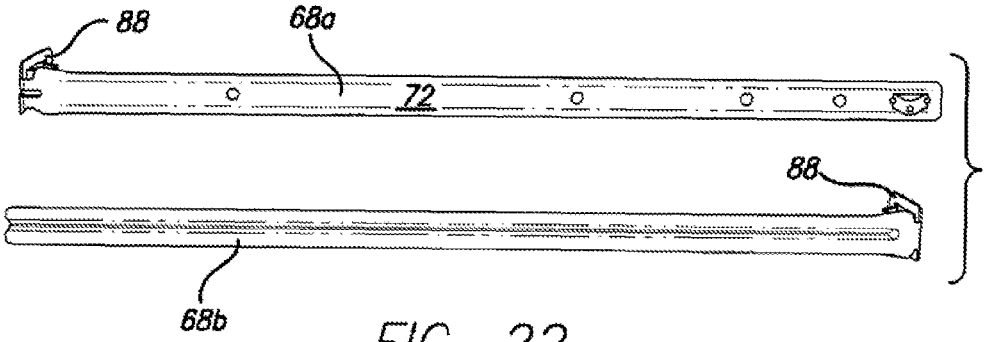
FIG. 22 is a front perspective view of the elongated elements of the boot hanger arms in a first version of the preferred embodiment.
Figure 23A:
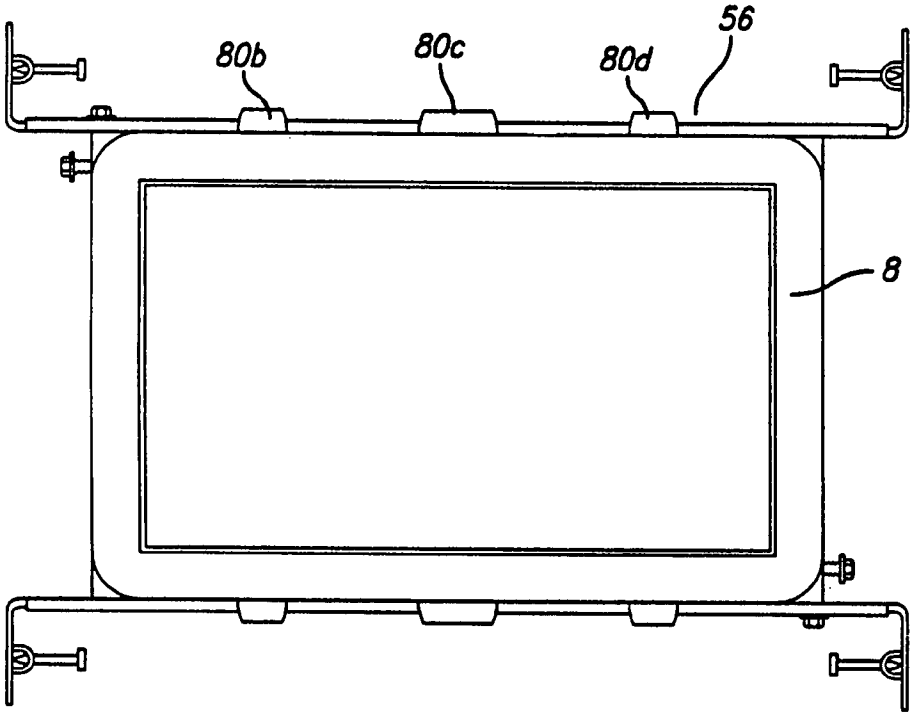
FIG. 23*a* is a top view of the boot hanger mounting bracket with the insert according to one version of the preferred embodiment.
Figure 23B:
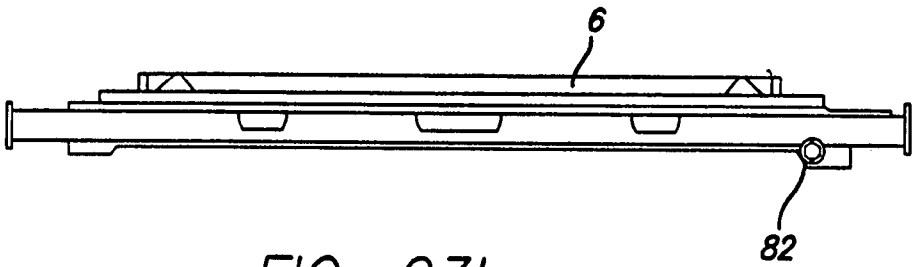
FIG. 23*b* is a side view of the boot hanger mounting bracket with the insert and gasket according to one version of the preferred embodiment.
Figure 23C:
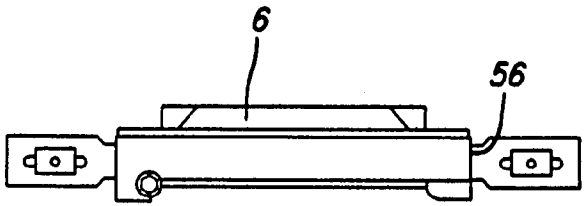
FIG. 23*c* is a side view of the boot hanger mounting bracket with the insert and gasket according to one version of the preferred embodiment.
Figure 24A:
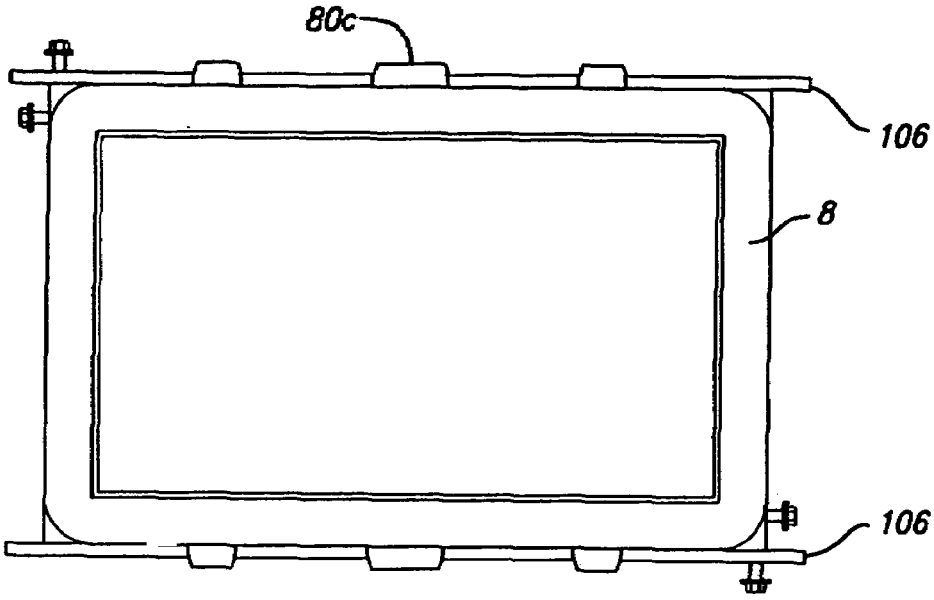
FIG. 24*a* is a top view of the boot hanger mounting bracket and extended portions according to one version of the preferred embodiment.
Figure 24B:
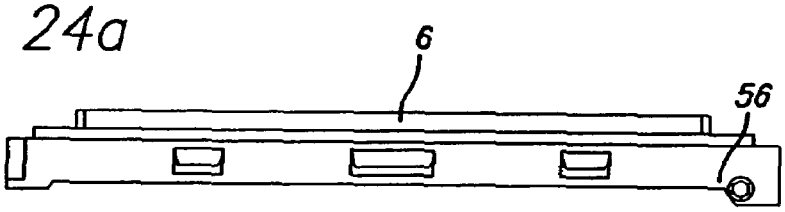
FIG. 24*b* is a side view of the boot hanger mounting bracket and extended portions according to one version of the preferred embodiment.
Figure 24C:
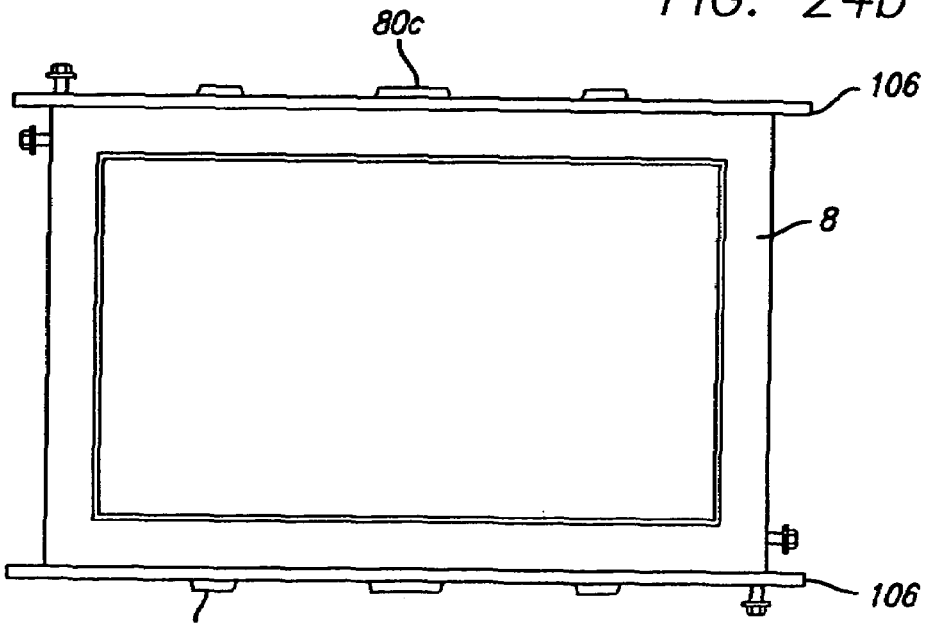
FIG. 24*c* is a bottom view of the boot hanger mounting bracket and extended portions according to one version of the preferred embodiment.
Figure 24D:
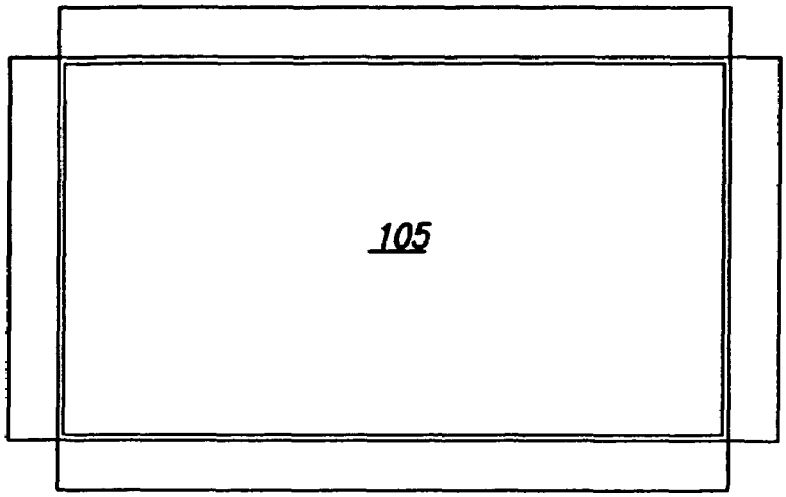
FIG. 24*d* is a top view of a fold pattern layout for the insert in one version of the preferred embodiment.
Figure 24E:
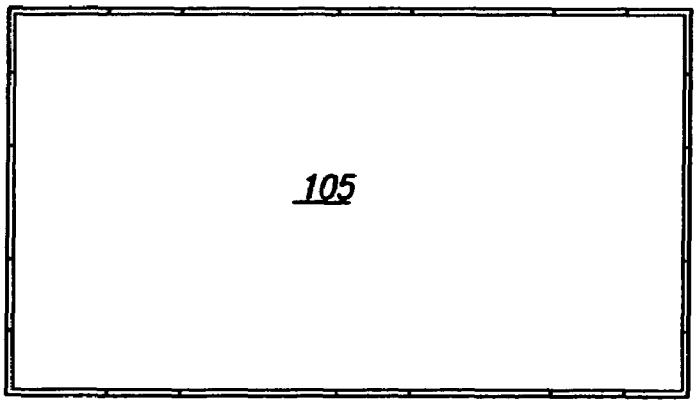
FIG. 24*e* is a top view of the insert in one version of the preferred embodiment.
Figure 24F:
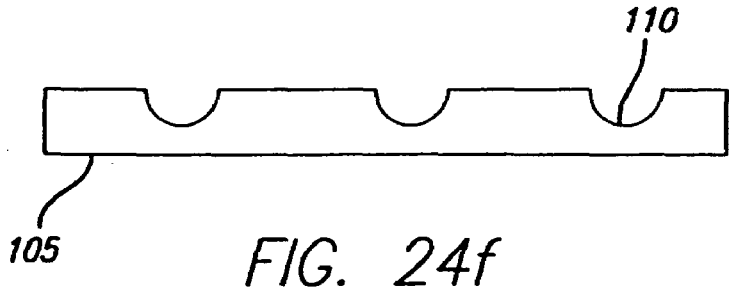
FIG. 24*f* is a side view of the insert in one version of the preferred embodiment.
Figure 24G:
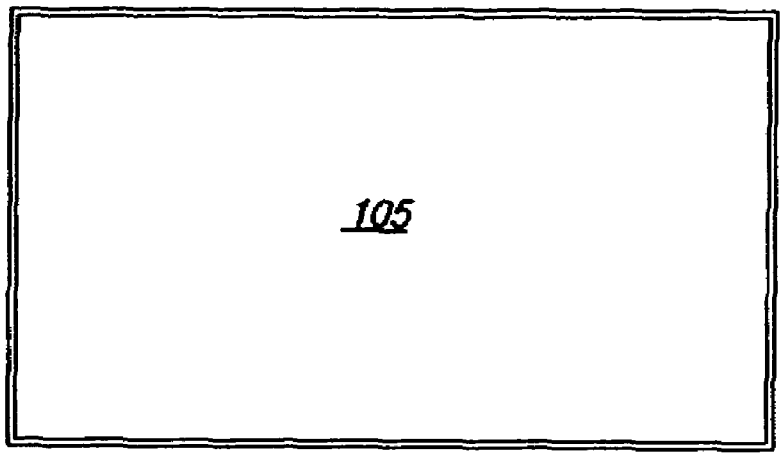
FIG. 24*g* is a bottom view of the insert in one version of the preferred embodiment.
Figure 24H:
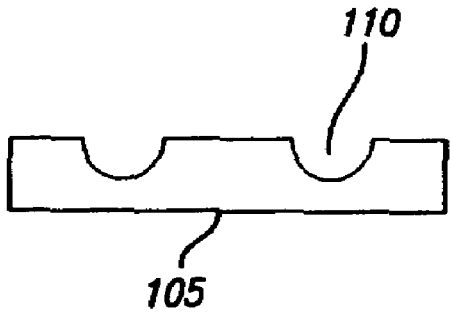
FIG. 24*h* is a side view of the insert in one version of the preferred embodiment.
Figure 24I:
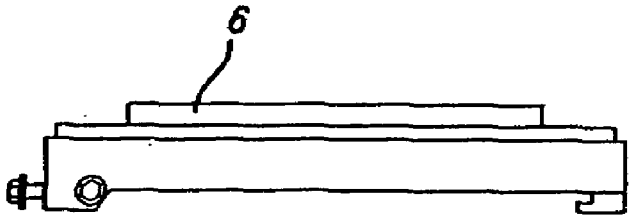
FIG. 24*i* is a side view of the boot hanger mounting bracket and insert in one version of the preferred embodiment.
Figure 25B:
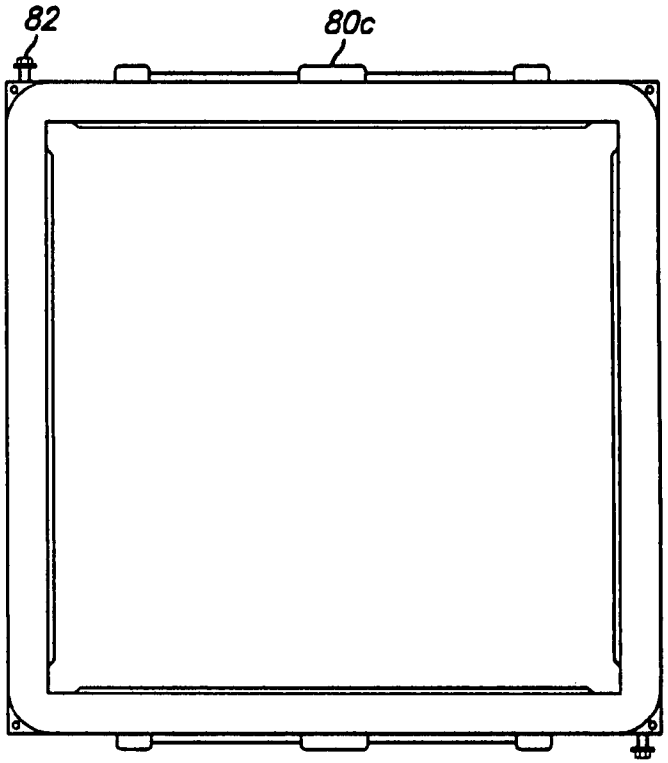
FIG. 25*b* is a top view of the assembled boot hanger mounting bracket in one version of the preferred embodiment.
Figure 25C:
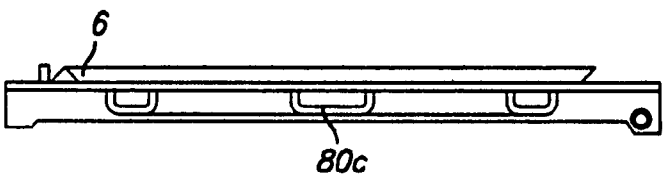
FIG. 25*c* is a side view of the assembled boot hanger mounting bracket in one version of the preferred embodiment.
Figure 25A:
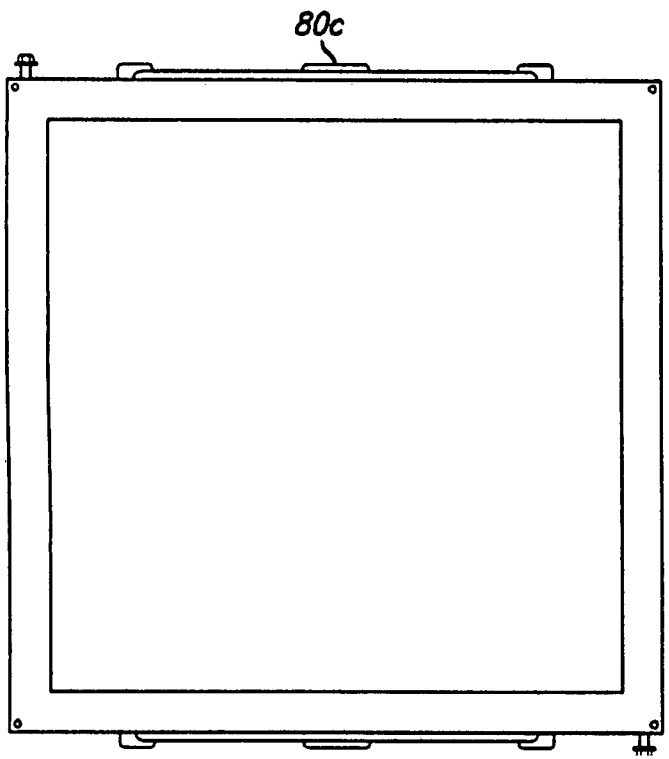
FIG. 25*a* is a bottom view of the assembled boot hanger mounting bracket in one version of the preferred embodiment.

FIGS. 1 and 7 show the configured boot hanger mounting bracket assembly 4 attached to spaced apart ceiling joists 58 of a building structure by boot hanger arms 56. The boot hanger arms 56 are attached to the ceiling joists 58 by a securing member 66 such as staples, screws or nails, bell-headed nails, or other suitable fasteners. The boot hanger arm 56 may be comprised of two linear elements 68*a*, 68*b* and a bracket 70 (see e.g., FIGS. 18, and 22). The linear elements 68*a*, 68*b* have a front surface 72 and a rear surface 74 and lengthwise edges 76*a*, 76*b* (see e.g., FIGS. 9-10 and 18-19).

Figure 9A:
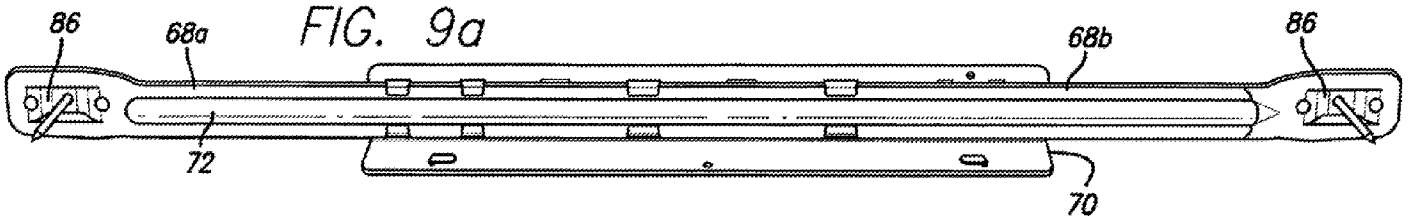
FIG. 9*a* is a perspective front view of the linear elements and bracket of the boot hanger arm in an alternate version of the present invention.
Figure 9B:
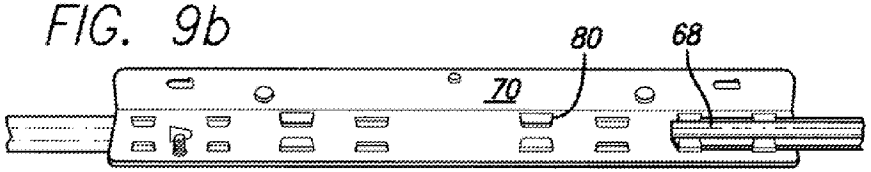
FIG. 9*b* is a perspective rear view of the bracket of the boot hanger arm in an alternate version of the present invention.
Figure 10A:
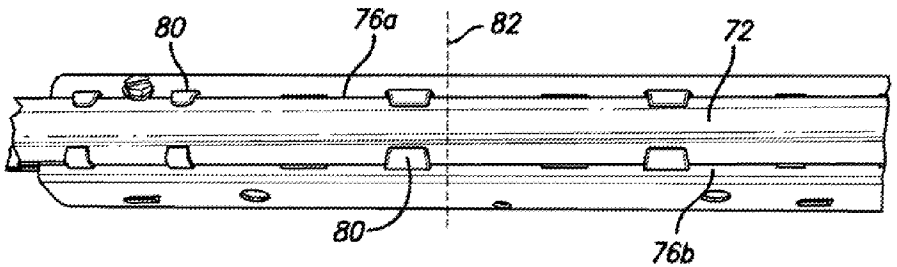
FIG. 10*a* is a perspective front view of the bracket of the boot hanger arm in an alternate version of the present invention.
Figure 10B:
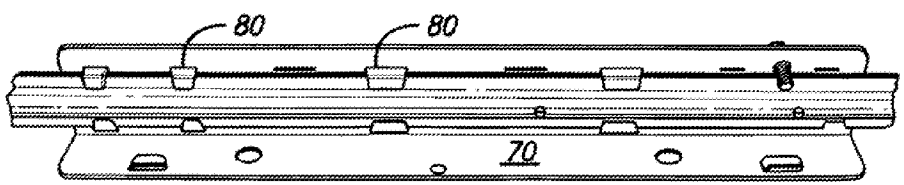
FIG. 10*b* is a perspective rear view of the bracket of the boot hanger arm in an alternate version of the present invention.
Figure 12A:
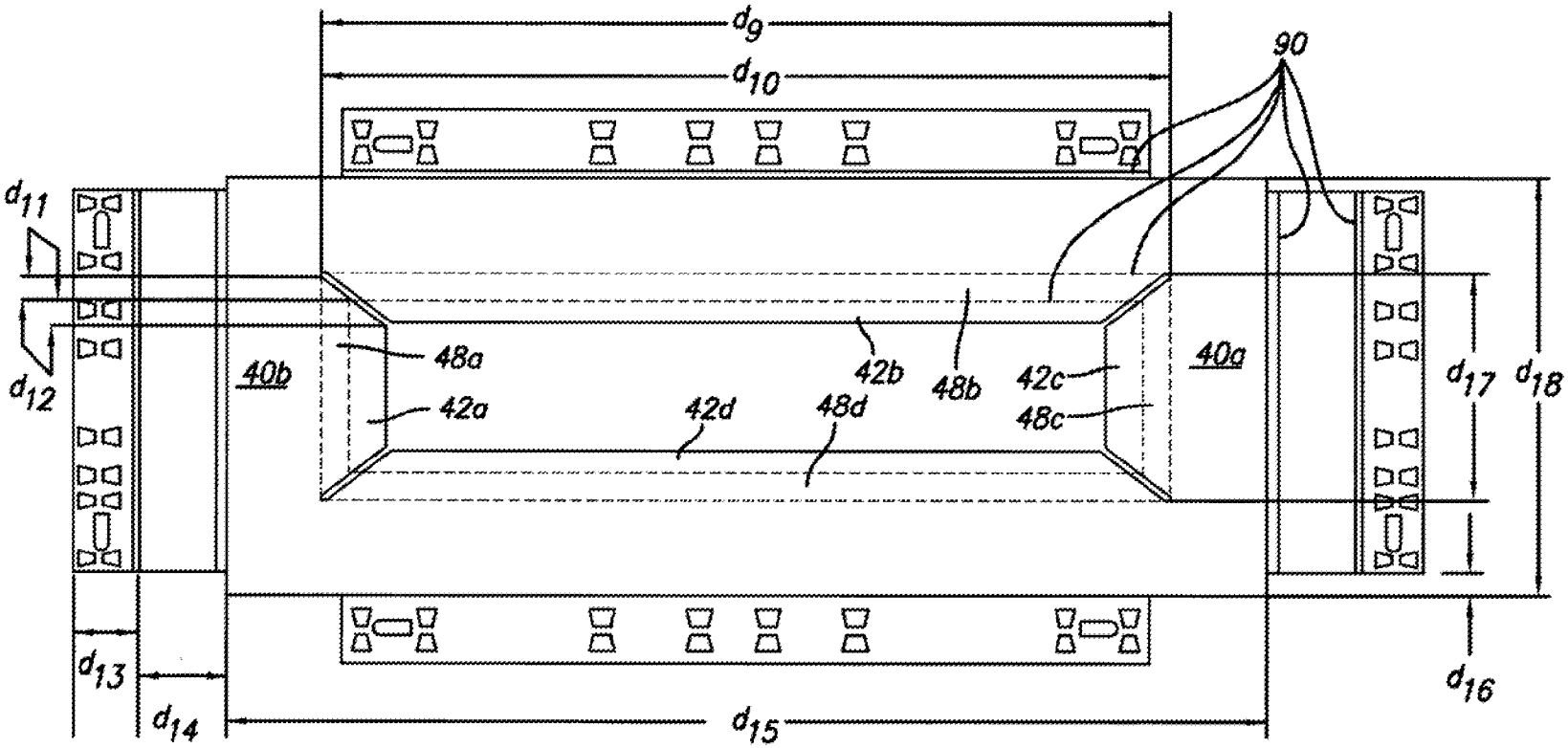
FIG. 12*a* is a top exploded view of the boot hanger frame portion and support member in an alternate version of the present invention.
Figure 13:
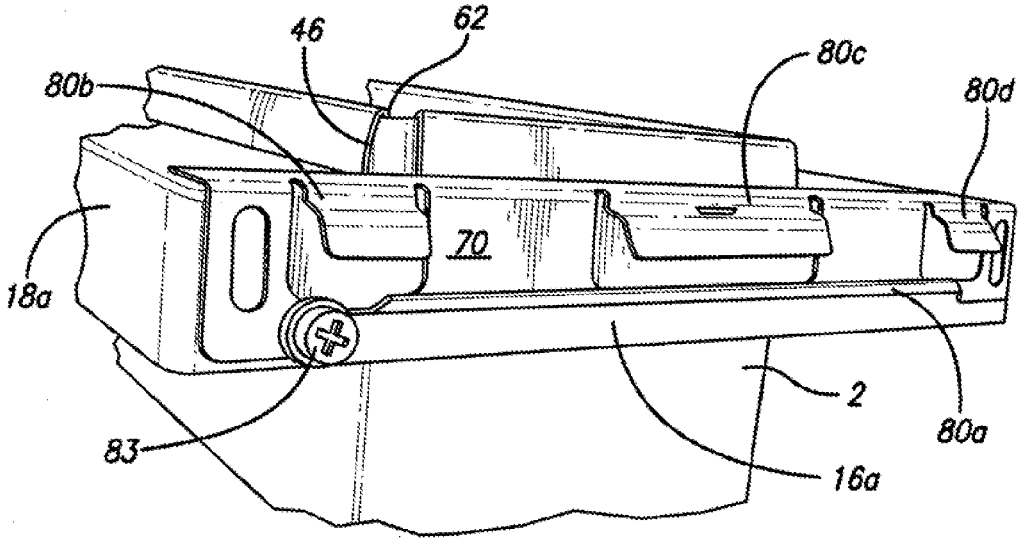
FIG. 13 is a side perspective view of the ductwork component, bracket and boot hanger frame portion in a first version of the preferred embodiment.
Figure 19:
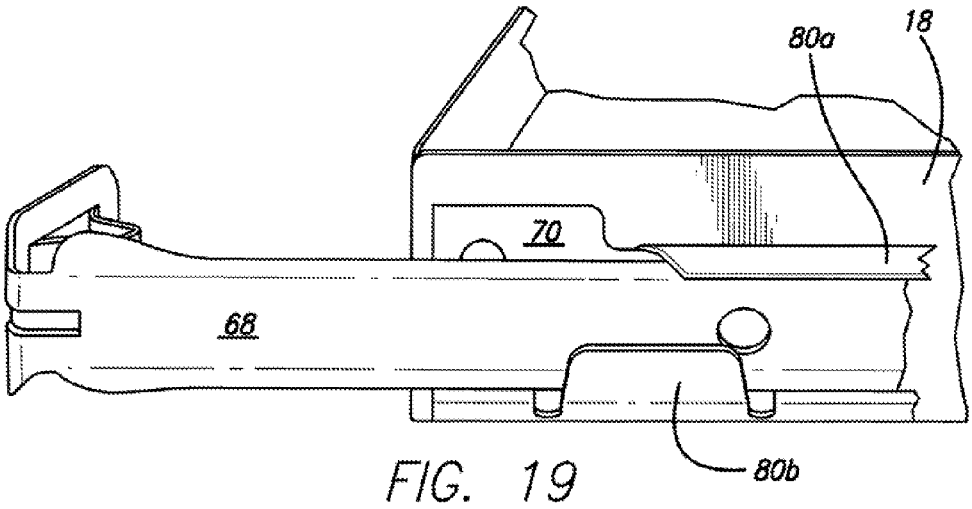
FIG. 19 is a front perspective view of the elongated element of the boot hanger arms and the bracket in a first version of the preferred embodiment.
Figure 20:
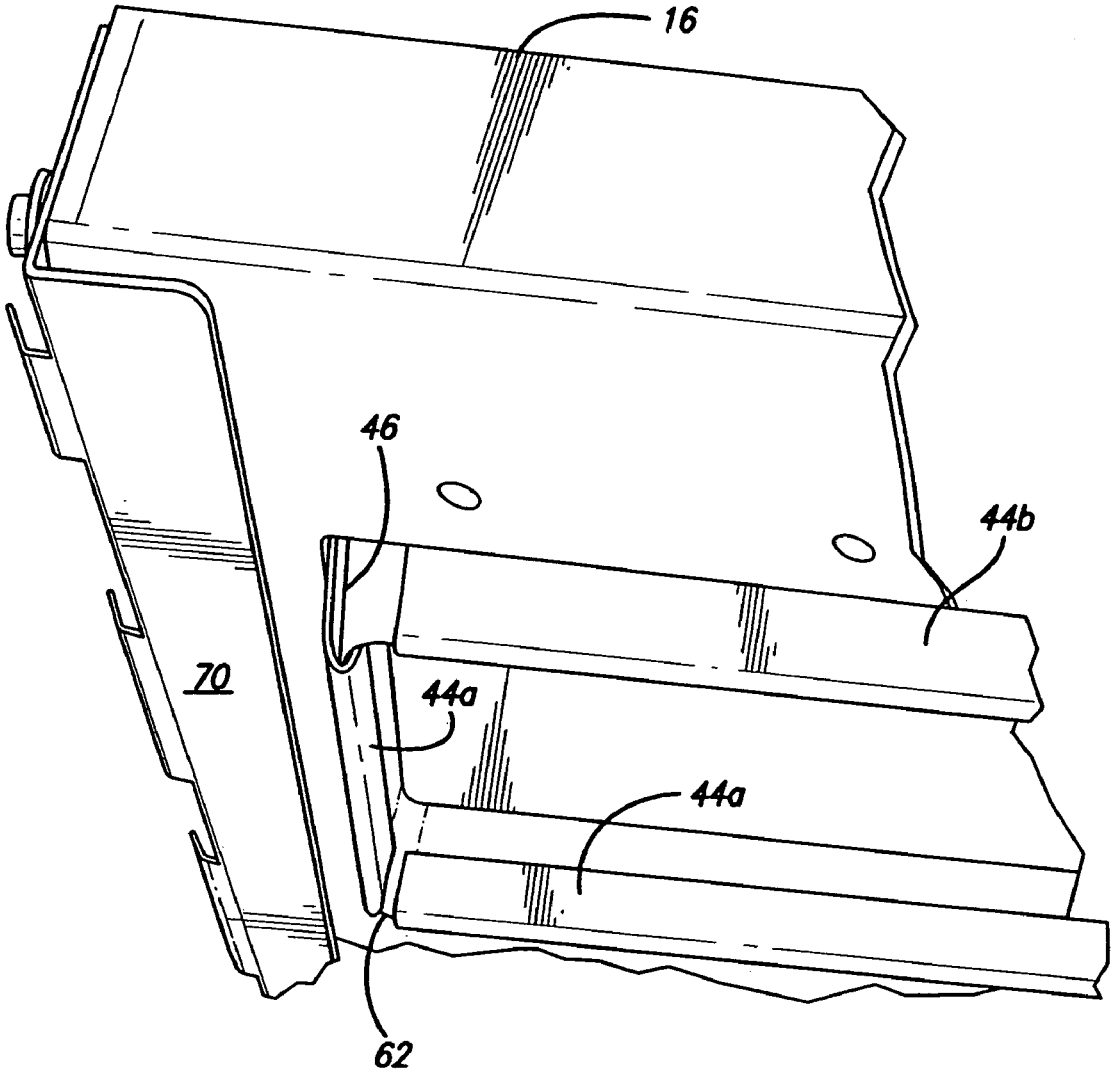
FIG. 20 is a side perspective view of the sidewalls of the support member, the boot hanger frame portion and the bracket in a first version of the preferred embodiment.
Figure 21:
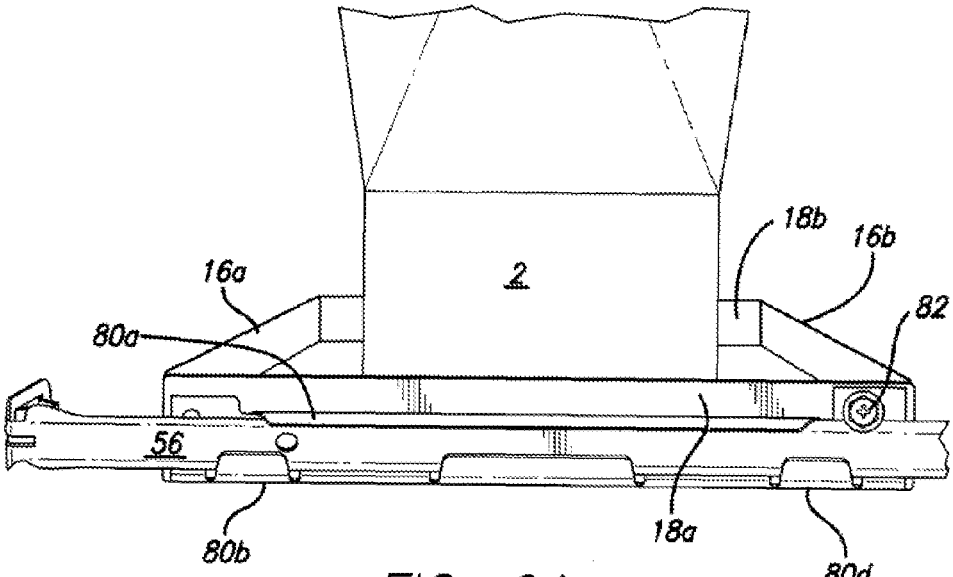
FIG. 21 is a front perspective view of the ductwork component, boot hanger arms and the bracket in a first version of the preferred embodiment.

Linear elements 68*a*, 68*b* are preferably configured so that they interface and are in sliding engagement with each other, permitting them to extend telescopically when interfaced. The two linear elements 68*a*, 68*b* preferably interface with the bracket 70 so that they are in sliding engagement with each other and with the bracket 70 (FIGS. 9*a*, 19, and 21). The bracket 70 preferably comprises a plurality of engaging structure such as tabs, hooks or grooves (FIGS. 13, 19, and 21). Alternately, the engaging structure may be formed integral with the boot hanger frame portion 8 to interface with the linear elements 68, without the need for a bracket 70. In a first version of the preferred embodiment, the bracket 70; or at least one of the flanges, if a bracket is not used; preferably comprises a single lengthwise groove 80*a* and three tabs 80*b*, 80*c*, 80*d*, although other configurations may also be suitable. In the preferred embodiment, tabs 80*b*, 80*c*, 80*d* may be arranged along the length of one side of the bracket 70 (see e.g., FIG. 13) or flange 16 or 18. Groove 80*a* is preferably arranged along the length of the opposite side of the bracket 70, or side of the boot hanger frame portion 8.

Groove 80*a* and tabs 80*b*, 80*c*, 80*d* preferably receive the edges of the linear element(s) 68, while permitting the linear element 68 to move and adjust laterally in a sliding manner towards and away from the midpoint 82 of the bracket 70; or from a point on the flange (e.g. where a bracket is not used). The configuration of the linear elements 68*a*, 68*b*, groove 80*a* and tabs 80*b*, 80*c*, 80*d* permit adjustment of the boot hanger arm 56 to fit the particular dimensions of the ductwork and structure, such as the distance between ceiling joists 58.

Additionally, extended portions 106, if present on the boot hanger frame portion 8 flanges 16 or 18, permit added flexibility in that a set of boot hanger arms may be added on-site without the need for attaching an additional bracket 70. For example, boot hanger arm(s) 56 may be added to a side of the boot hanger frame portion 8 that does not include a bracket 70 by inserting the elongated elements 68 of the boot hanger arm(s) 56 through cut-outs 107 on the extended portion(s) 106 of parallel flanges (e.g., 18*a*, 18*b* or 16*a*, 16*b*), if, for example, the need arises at the work site. The boot hanger frame portion 8 may also be configured without any bracket (s) and with extended portions 106 being used for interfacing with the elongated elements 68. The extended portions 106 and cut-outs 107, also permit simplification of the manufacturing process in that fewer or no brackets 70 need to be fabricated and attached to the boot hanger frame portion 8.

Once adjusted to the particular application, the configuration of the boot hanger arm or arms 56 may be secured via a securing member 83 such as, for example, a screw and hole assembly that tightens to secure an edge of at least one of the linear elements 68 and prevents it from further sliding or movement (e.g., FIG. 13, FIG. 21).

Where brackets 70 are utilized, they may be secured to each of two parallel flanges of the boot hanger frame portion 8, e.g., 18*a*, 18*b* or 16*a*, 16*b*, although other configurations may be suitable, such as on each of the four flanges. The bracket 70 may be secured to the boot hanger frame portion 8 by a securing material 84 such as button punches, rivets, spot welds, glue, screws, epoxy, or other suitable structure. The linear elements 68 of each boot hanger arm 56 preferably comprise a hole 86 at their distal ends 88 (e.g., FIG. 9*a*) so that the boot hanger arm 56 may be secured to the ceiling joists 58 or other part of the structure by a securing member 66, such as nails or screws.

Once the boot hanger mounting bracket 4-ductwork component 2 assembly has been secured to the structure, an airflow control structure 36 such as a grille louver or register may be fit to the opening defined by the configured boot hanger mounting bracket assembly 4. If desired, the airflow control structure 36 may also be attached to the ceiling lid 60 or other part of the structure by a securing member such as threaded screws. The boot hanger mounting bracket 4, however, may be used as a support for the airflow control structure 36, thereby lessening the need to utilize the ceiling lid 60, or other building structure for its support. The airflow control structure 36 will generally comprise sidewalls forming a passageway directing airflow from the duct through the register, as well as adjustable louvers for controlling the airflow. The louvers may be selectively rotatable by the user to control the direction and volume of airflow, including blocking the passageway. The perimeter of the air flow control structure 36 preferably extends beyond the duct opening to abut against the ceiling lid 60 floor or wall on opposite sides of the duct opening to prevent gaps and to provide an aesthetic appearance.

While the present invention has been described with regards to particular embodiments, it is recognized that additional variations of the present invention may be devised without departing from the inventive concepts. Additionally, the following Examples are presented to further illustrate preferred embodiments of the invention but are not intended to limit the present invention.

EXAMPLE I

Dimensions of a First Version of Support Member and Boot Hanger Frame Portion for Boot Hanger Mounting Bracket Assembly

| Dimension | Approx. Measurement in cm |
|---|---|
| boot hanger frame portion width, w | 20 cm |
| rearward facing flange 16 along width, w, of boot hanger frame portion (finished length) | 20 cm |
| boot hanger frame portion length, l | 36 cm |
| rearward facing flange 18 along length, l, of boot hanger frame portion (finished length) | 36 cm |
| Overlap portion 102 of lengthwise flanges | Approximately 1 cm on each end of flange |
| Opening 12b in finished boot hanger mounting bracket | 30 cm (length) × 10 cm (width) |
| Size of support member 6 along length, l, of boot hanger frame portion 8 | 4.5 cm (width) × 29.5 cm (length) |
| Size of support member 6 along width, w, of boot hanger frame portion 8 | 4.5 cm (width) × 9.0 cm (length) |
| Width of lip 50 | 2.5 cm |
| Total width of inner tab 42 and outer tab 48 of support member(s) | 2.0 cm |
| Depth of pocket 46 | 1 cm |

EXAMPLE II

Dimensions of s Second Version of Support Member and Boot Hanger Frame Portion for Boot Hanger Mounting Bracket Assembly

| Dimension | Approx. Measurement in cm |
|---|---|
| boot hanger frame portion 8 width, w | 36 cm |
| boot hanger frame portion 8 length, l | 36 cm |
| Opening 12b in finished boot hanger mounting bracket 4 | 30 cm (length) × 30 cm (width) |

Information as herein shown and described in detail is fully capable of attaining the above-described object of the invention, the presently preferred embodiment of the invention, and is, thus, representative of the subject matter which is broadly contemplated by the present invention. The scope of the present invention fully encompasses other embodiments which may become obvious to those skilled in the art, and is to be limited, accordingly, by nothing other than the appended claims, wherein reference to an element in the singular is not intended to mean "one and only one" unless explicitly so stated, but rather "one or more." All structural and functional equivalents to the elements of the above-described preferred embodiment and additional embodiments that are known to those of ordinary skill in the art are hereby expressly incorporated by reference and are intended to be encompassed by the present claims.

Moreover, no requirement exists for a device or method to address each and every problem sought to be resolved by the present invention, for such to be encompassed by the present claims. Furthermore, no element, component, or method step in the present disclosure is intended to be dedicated to the public regardless of whether the element, component, or method step is explicitly recited in the claims. However, that various changes and modifications in form, material, and fabrication material may be made, without departing from the spirit and scope of the inventions as set forth in the appended claims, should be readily apparent to those of ordinary skill in the art. No claim herein is to be construed under the provisions of 35 U.S.C. §112, sixth paragraph, unless the element is expressly recited using the phrase "means for."

INDUSTRIAL APPLICABILITY

This invention industrially applies to duct systems, registers and register boots, used as air ducts for warm air heating, ventilating, and/or air conditioning systems. More specifically, the present invention industrially applies to improvements for mounting and installing the components of the duct system, including register boots, mud rings and air registers, in the walls, floors, or ceilings of buildings.

What is claimed:

1. An apparatus for mounting ductwork of heating, ventilation, and cooling systems in a building structure, comprising:

a boot hanger frame portion comprising two pairs of parallel sides defining an opening;

at least one support member comprising parallel sidewalls defining a pocket, wherein an edge of the ductwork fits into the pocket, and wherein the support member interfaces with the boot hanger frame portion;

at least one flange projecting rearwardly from the boot hanger frame portion and comprising a pair of parallel edges and a rear edge;

at least one boot hanger arm, wherein the boot hanger arm interfaces with the flange and attaches to the building structure, each arm having two feet, each foot having an extended height for facilitating use thereof with a plurality of building projects which use at least one feature selected from a group consisting essentially of a rated channel and a channel furring strip; and an insert disposed within an opening of a duct during installation, the insert comprising a cover having a portion for accommodating at least one element selected from a group consisting essentially of text, a logo, and a trademark, wherein the opening of the duct covered by the inset is located in a front of the apparatus; and wherein the flange comprises at least one extended portion that extends beyond the side of the boot hanger frame portion from which the flange frame projects and a length of the flange is greater then a length of the side of the boot hanger frame portion from which it projects; and wherein the extended portion comprises a cut out; and wherein the cut out receives a portion of the boot hanger arm.

2. The apparatus of claim 1, comprising first and second boot hanger arms and at least a first rearwardly projecting flange and a second rearwardly projecting flange disposed in parallel relation to one another, wherein each of the first and second flanges comprise extended portions at their respective parallel edges, and wherein each of the extended portions comprises a cut out.

3. The apparatus of claim 2, wherein the cut outs on the extended portions of the first flange receive a portion of the first boot hanger arm, and wherein the cut outs on the extended portions of the second flange receive a portion of the second boot hanger arm.

4. The apparatus of claim 3, further comprising a pair of support members disposed in parallel relation to one another.

5. An apparatus for mounting ductwork of heating, ventilation, and cooling systems in a building structure, comprising:

a boot hanger frame portion comprising two pairs of parallel sides defining an opening;

at least a pair of support members disposed in parallel relation to one another and each interfacing with the boot hanger frame portion, wherein each support member comprises parallel sidewalk defining a pocket, and wherein an edge of the ductwork sits in the pocket;

a first flange and a second flange, wherein the first and second flanges each project rearwardlv from the boot hanger frame portion and each comprise a pair of parallel edges and a rear edge;

a first boot hanger arm and a second boot hanger arm, wherein the first and second boot hanger arms interface respectively with the first and second flanges and attach to the building structure, each arm having two feet, each foot having an extended height for facilitating use thereof with a plurality of building projects which use at least one feature selected from a group consisting essentially of a rated channel and a channel furring strip; and an insert disposed within an opening of a duct opening during installation, wherein the insert is removed before operation of the heating, cooling or ventilation system, the insert comprising a cover having a portion for accommodating at least one element selected from a group consisting essentially of text, a logo, and a trademark; wherein the opening of the duct covered by the insert is located in a front of the apparatus; and wherein the first and second flanges each comprise an extended portion at their parallel ends, and wherein each of said extended portions extends beyond the respective side of the boot hanger frame portion from which the first and second flange project and a length of each of the first and second flanges is greater than a length of the respective side of the boot hanger frame portion from which the first and second flanges project; and wherein the extended portions each comprise a cut out for receiving a portion of one of the first and second boot hanger arms.

6. The apparatus of claim 5, wherein a portion of each of the first and second flanges forms an overlap with an adjacent flange projecting rearward from the boot hanger frame portion.

* * * * *